US008727795B2

(12) United States Patent
Feyder et al.

(10) Patent No.: US 8,727,795 B2
(45) Date of Patent: May 20, 2014

(54) HIGH DENSITY ELECTRICAL CONNECTOR HAVING A PRINTED CIRCUIT BOARD

(75) Inventors: Igor Feyder, Stoughton, MA (US); Francesco A. Nania, Clinton, MA (US)

(73) Assignee: Hypertronics Corporation, Hudson, MA (US)

( * ) Notice: Subject to any disclaimer, the term of this patent is extended or adjusted under 35 U.S.C. 154(b) by 116 days.

(21) Appl. No.: 13/448,188

(22) Filed: Apr. 16, 2012

(65) Prior Publication Data

US 2012/0264335 A1 Oct. 18, 2012

Related U.S. Application Data

(60) Provisional application No. 61/476,131, filed on Apr. 15, 2011.

(51) Int. Cl.
*H01R 12/00* (2006.01)

(52) U.S. Cl.
USPC ..... 439/76.1

(58) Field of Classification Search
USPC ..... 439/62, 74, 631, 633, 636, 637, 638, 439/76, 1
See application file for complete search history.

(56) References Cited

U.S. PATENT DOCUMENTS

| | | | | |
|---|---|---|---|---|
| 3,740,698 | A * | 6/1973 | Jerominek | 439/61 |
| 5,024,609 | A | 6/1991 | Piorunneck | |
| 5,051,099 | A * | 9/1991 | Pickles et al. | 439/108 |
| 5,547,405 | A * | 8/1996 | Pinney et al. | 439/894 |
| 5,785,556 | A | 7/1998 | Pratt et al. | |
| 5,810,620 | A * | 9/1998 | Kobayashi et al. | 439/607.41 |
| 5,830,017 | A | 11/1998 | Owsley et al. | |
| 5,954,521 | A | 9/1999 | Yang | |
| 6,139,372 | A * | 10/2000 | Yang | 439/701 |
| 6,226,166 | B1 | 5/2001 | Gumley et al. | |
| 6,254,435 | B1 | 7/2001 | Cheong et al. | |
| 7,101,188 | B1 | 9/2006 | Summers et al. | |
| 7,470,155 | B1 | 12/2008 | Soubh et al. | |
| 7,549,884 | B2 | 6/2009 | Soubh et al. | |
| 7,632,126 | B1 * | 12/2009 | Farole et al. | 439/314 |
| 7,654,847 | B2 | 2/2010 | Soubh et al. | |

(Continued)

FOREIGN PATENT DOCUMENTS

| | | |
|---|---|---|
| JP | 2003-070156 | 3/2003 |
| JP | 2003-111270 | 4/2003 |

OTHER PUBLICATIONS

Edge Rate—Formed Edge Rate Contacts Offer High Speeds and High Cycle Life, 2 pages, Samtec, Inc. Dec. 2010.

*Primary Examiner* — Neil Abrams
*Assistant Examiner* — Phuongchi T Nguyen
(74) *Attorney, Agent, or Firm* — Snell & Wilmer LLP

(57) ABSTRACT

A high density mated pair connector having a printed circuit board ("PCB") and a contact module to facilitate electrical connections through the mated pair connector. A receptacle assembly accepts receptacle cables and electrically connects the receptacle cables to a receptacle PCB coupled with a receptacle body. A plug assembly accepts plug cables and electrically connects the plug cables to a plug PCB coupled with a plug body. A contact module is coupled with the plug body and has a plurality of contacts. A first end of the plurality of contacts electrically connects with the plug PCB. A second end of the plurality of contacts is configured to electrically connect with the receptacle PCB. Upon mating, the plurality of contacts of the contact module couple to the receptacle PCB, thus electrically connecting the receptacle cables with the plug cables.

20 Claims, 17 Drawing Sheets

(56) References Cited

U.S. PATENT DOCUMENTS

| | | | | |
|---|---|---|---|---|
| 7,922,520 | B2 * | 4/2011 | Mizukami | 439/493 |
| 2006/0120005 | A1 | 6/2006 | Van Sickle | |
| 2006/0139832 | A1 | 6/2006 | Yates et al. | |
| 2007/0270017 | A1 | 11/2007 | Hardracker et al. | |
| 2009/0137155 | A1 | 5/2009 | Yeh et al. | |
| 2010/0130063 | A1 | 5/2010 | Lang et al. | |

* cited by examiner

HIGH DENSITY ELECTRICAL CONNECTOR HAVING A PRINTED CIRCUIT BOARD

CROSS REFERENCE TO RELATED APPLICATIONS

This application claims the benefit and priority of U.S. Provisional Application No. 61/476,131, entitled "Electrical Connector Having a Printed Circuit Board," filed on Apr. 15, 2011, the entire contents of which are hereby incorporated by reference herein.

BACKGROUND

1. Field

The present invention relates generally to mated pair connectors and improvements thereto and more particularly pertains to high density mated pair connectors utilizing a printed circuit board therein and improvements thereto.

2. Description of the Related Art

Electrical connectors for interfacing between separated systems or electronic devices are widely used in the art. Conventional electrical connectors utilize a series of pins on a first half of the connector and a corresponding series of sockets on a second half of the connector. When the two halves are mated together, the sockets receive the pins in order to electrically connect and provide a conductive pathway through the electrical connector. Thus, when one system or electronic device is electrically coupled with the pins of the first half of the connector and a second system or electronic device is electrically coupled with the sockets of the second half of the connector, the two systems or devices may be electrically connected through the mated connector.

As systems and devices increase in complexity, the need has arisen for high density electrical connectors capable of electrically connecting increasingly large numbers of signals with one another. One type of electrical connector that has seen use in the electronic industry is a card edge connector. Conventional card edge connectors employ a slotted surface configured to couple or mate with an exposed edge of a printed circuit card or board. Electrically conductive surfaces on the exposed edge of the printed circuit card or board interface with a similarly situated row of electrical contacts in the slotted surface of the card edge connector.

A significant downside to such interfaces, however, results from the fact that card edge connectors require an exposed printed circuit board be incorporated in the utilizing application. Such a physical constraint is not viable for many new system designs. Moreover, not only do many current systems that would benefit from high density electrical connections not meet such a requirement, but modifying such systems to utilize these exposed electrical conductors can result in significant reliability and safety concerns. Conductive and potentially power-carrying electrical contacts must be left exposed to the surrounding, and potentially intrusive, outside environment. Not only does this exposure risk contamination or degradation of the electrical contacts over time due to weather or other contaminants in the air, but also exposes the conductive terminals of the system where a human being may accidentally come into contact with them. Electrical shock risks can be extremely dangerous, many times fatal, if the system is capable of high current or voltage levels.

In addition, depending upon the configuration or orientation of the conductive surfaces on the exposed edge, a card edge connector may need to be specifically designed or independently manufactured for the specific circuit board utilized in the corresponding system. As such, card edge connectors may not be transferable between different customers or even for differing systems of the same customer, increasing the cost of their manufacturing due to the specialty nature of their construction. Such limited-use designs are particularly undesirable as systems increase in complexity and must respond to a larger number of signals since consumers have become ever more cost conscious when searching for suitable electrical interfacing for their growing systems. Therefore, a need exists for an improved high density electrical connector. Ideally, such an electrical connector would allow for a large number of signals to be propagated, would be inexpensive to manufacture, would be scalable, would be safe to use, and would provide sufficient protection against electrical interference.

SUMMARY

A mated pair electrical connector utilizing a printed circuit board for providing a high density and low cost solution to facilitate an electrical connection therethrough is disclosed.

In one embodiment, an electrical connector may include a first housing defining a cavity therein and a first printed circuit board disposed in the cavity of the first housing. A first contact is coupled with the first printed circuit board. In addition, the electrical connector may include a second housing defining a cavity therein and a second printed circuit board disposed in the cavity of the second housing, the second printed circuit board having a first contact pad positioned on a surface of the second printed circuit board, the first contact pad of the second printed circuit board configured to engage with the first contact if the first housing and the second housing are mated together.

In another embodiment, a connector for providing an electrical connection between a first conductor and a second conductor may include a first housing and a first circuit board coupled to the first housing. The first circuit board may have a first contact pad on the first circuit board, a second contact pad on the first circuit board adjacent to the first contact pad, a third contact pad on the first circuit board and electrically connected with the first contact pad and a fourth contact pad on the first circuit board adjacent to the third contact pad and electrically connected with the second contact pad. A first contact is coupled to the first housing and electrically connected with the first contact pad. A second contact is coupled to the first housing and electrically connected with the second contact pad. The connector may also include a second housing configured to mate with the first housing and a second circuit board coupled to the second housing. The second circuit board may have a first contact pad on the second circuit board, a second contact pad on the second circuit board adjacent to the first contact pad of the second circuit board, a third contact pad on the second circuit board and electrically connected with the first contact pad of the second circuit board and a fourth contact pad on the second circuit board adjacent to the third contact pad of the second circuit board and electrically connected with the second contact pad of the second circuit board. The first contact pad of the second circuit board may be configured to engage the first contact and the second contact pad of the second circuit board may be configured to engage the second contact when the first housing and the second housing are mated together.

In yet another embodiment, a connector for providing an electrical connection between at least one first cable and at least one second cable may include a first assembly including a first outer housing defining a first opening, the first opening configured to receive the at least one first cable. A first body is positioned at least partially in the first outer housing and a first printed circuit board is connected to the first body and configured to electrically connect to the at least one first cable. A contact module having a conductive contact is electrically connected to the first printed circuit board. A contact module holder is connected to the first body and receives the contact module, the contact module holder defining a contact pocket for receiving the conductive contact of the contact module. In addition, the connector may include a second assembly configured to mate with the first assembly, the second assembly including a second outer housing defining a second opening, the second opening configured to receive the at least one second cable. A second body is positioned at least partially in the second outer housing. A second printed circuit board is connected to the second body and configured to electrically connect to the at least one second cable, the second printed circuit board having a conductive pad disposed on a first surface of the second printed circuit board and configured to engage with the conductive contact of the contact module when the first assembly and the second assembly are mated together.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1:
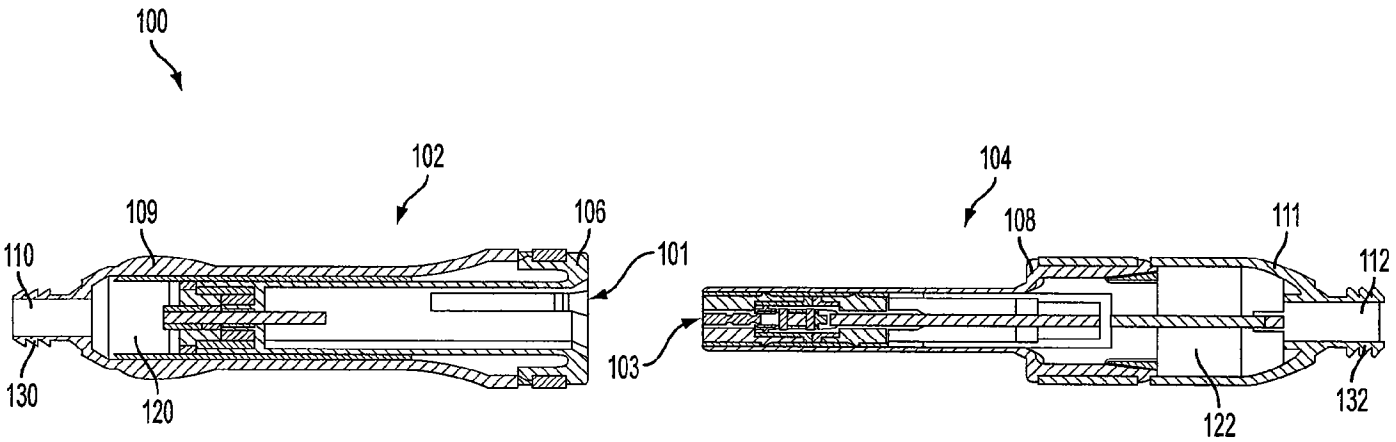
FIG. 1 is a cut-away side view of an electrical connector utilizing printed circuit boards in an unmated configuration according to an embodiment of the invention.

Referring first to FIG. 1, an electrical connector 100 is shown in an unmated configuration. A receptacle assembly 102 has a receptacle mating end 101 and a plug assembly 104 has a plug mating end 103. The receptacle assembly 102 includes a receptacle body 106 and an outer receptacle housing 109. The receptacle housing 109 defines a cavity 120 therein for receiving at least a portion of the receptacle body 106. Similarly, the plug assembly 104 includes a plug body 108 and an outer plug housing 111. The plug housing 111 also defines a cavity 122 therein for receiving at least a portion of the plug body 108.

At a cable end of the receptacle assembly 102, opposite the mating end 101, the receptacle housing 109 contains an opening 110 to permit wires, cables, or other conductors to enter the cavity 120 of the receptacle housing 109 and couple with or otherwise electrically connect with components disposed therein, as discussed in greater detail below. Similarly, at a cable end of the plug assembly 104, opposite the mating end 103, the plug housing 111 contains an opening 112 to permit wires, cables or other conductors to enter the cavity 122 of the plug housing 111 and couple with or otherwise electrically connect with components disposed therein, as discussed in greater detail below. Thus, by mating the receptacle assembly 102 and the plug assembly 104 together via their mating ends (101, 103), the wires, cables or other conductors entering the receptacle housing 109 may be electrically connected to wires, cables or other conductors entering the plug housing 111, as discussed in greater detail herein.

The cavities (120, 122) of the receptacle housing 109 or plug housing 111 may be any of a variety of shapes or sizes such that they adequately hold or contain various connector components within for facilitating their mating and electrical connection functionality, as discussed in greater detail herein. Furthermore, the openings (110, 112) of either the receptacle housing 109 or plug housing 111 may also be any of a variety of shapes or sizes such that they adequately permit a desired amount of conductive elements from an exterior of the receptacle housing 109 or plug housing 111 to the cavities (120, 122) within. The receptacle housing 109 may include a ribbed portion 130 surrounding a circumference or perimeter of its opening 110 for allowing a protective sheath (not shown) surrounding any of the wires, cables or other conductors disposed therethrough to fasten or secure with the receptacle housing 109. A same or similar ribbed portion 132 may be located on the plug housing 111 surrounding its opening 112.

Figure 2:
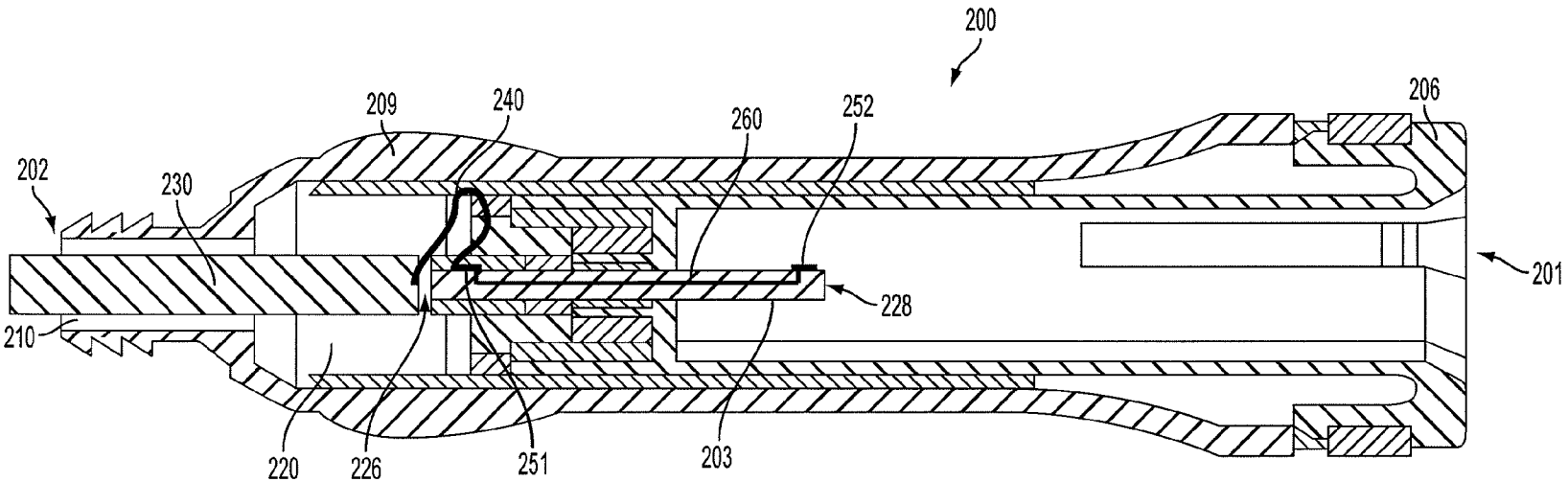
FIG. 2 is an enlarged cut-away side view of a receptacle assembly of an electrical connector according to an embodiment of the invention.

Referring next to FIG. 2, an enlarged cut-away side view of a receptacle assembly 200 of an electrical connector is shown. The receptacle assembly 200 may be the same or similar to the receptacle assembly 102 previously described for FIG. 1. The receptacle assembly 200 includes a receptacle housing 209 defining a cavity 220 therein and having a mating end 201 and a cable end 202 on an opposite side of the mating end 201. A receptacle body 206 is coupled to the receptacle housing 209 and at least partially disposed within the cavity 220 of the receptacle housing 209. The receptacle body 206 is configured to connect with various connector components, as described in greater detail herein, for holding or positioning the various connector components within the cavity 220 of the receptacle housing 209.

The receptacle housing 209 may be made of a metal (e.g., stainless steel) while the receptacle body 206 may be made of a plastic, rubber or other non-conductive material. In an alternative embodiment, any of a variety of materials may be used for either the receptacle housing 209 or the receptacle body 206. The various connector components may be connected directly to the receptacle body 206 and disposed within the cavity 220 of the receptacle housing 209 to form a stable unit having the receptacle housing 209 as an outer shell, as discussed in greater detail herein. In an alternative embodiment, no receptacle body 206 may be needed and the various connector components may instead be connected directly with the receptacle housing 209.

Within the cavity 220 of the receptacle housing 209, a receptacle printed circuit board ("PCB") 203 is coupled to the receptacle body 206 and held in a stable position. The receptacle PCB 203 may be coupled to the receptacle body 206 via clips, adhesives, or any other type of mechanical connection for facilitating a firm hold of the receptacle PCB 203 within the cavity 220 of the receptacle housing 209. In an alternative embodiment, additional components, for example a mechanical insert or PCB holding member configured to lock with the receptacle PCB 203, may be utilized for securing the receptacle PCB 203, in addition to or in replacement of the receptacle body 206.

The receptacle PCB 203 contains one or more conductive contact pads 251 disposed upon a surface of or near a cable portion or end 226 of the receptacle PCB 203. Similarly, the receptacle PCB 203 contains one or more corresponding conductive contact pads 252 disposed upon a surface of or near a mating portion or end 228 of the receptacle PCB 203. The contact pads (251, 252) at the two portions or ends (226, 228) are electrically connected with each other via conductive traces or pathways 260 extending along or through the receptacle PCB 203. Thus, a conductive pathway 260 is established from the one or more conductive pads 251 on the cable portion or end 226 to the corresponding one or more conductive pads 252 on the mating portion or end 228 of the receptacle PCB 203.

The receptacle housing 209 also includes an opening 210 at the cable end 202. The opening 210 may be the same or similar to the opening 110 of FIG. 1. A receptacle cable bundle 230 is allowed to enter the opening 210 and thus pass into the cavity 220 of the receptacle housing 209. The receptacle cable bundle 230 may include a plurality of cables, wires or other conductors or may only include one cable, wire or other conductor. The opening 210 may be manufactured with a variety of sizes or shapes (e.g. circular) so long as a cross-sectional area of the opening 210 is sufficient to permit the desired receptacle cable bundle 230 to pass through the opening 210 and into the receptacle housing 209.

Once within the cavity 220 of the receptacle housing 209, the receptacle cable bundle 230 is electrically connected to the receptacle PCB 203 also positioned within the cavity 220. Conductive portions of the cable bundle 230 are electrically connected 240 (e.g., soldered) to the conductive contact pads 251 on the cable portion or end 226 of the receptacle PCB 203. In an alternative embodiment, other connection means may be utilized for establishing an electrical pathway between the receptacle cable bundle 230 and the cable end 226 of the receptacle PCB 203. For example, the receptacle cable bundle 230 may be crimped or twisted with one or more conductive elements that extend towards the receptacle cable bundle 230 from the receptacle PCB 203. Thus, via the electrical traces or pathways 260 of the receptacle PCB 203, as discussed above, the receptacle cable bundle 230 is also electrically connected to the conductive contact pads 252 on the mating portion or end 228 of the receptacle PCB 203.

Figure 3:
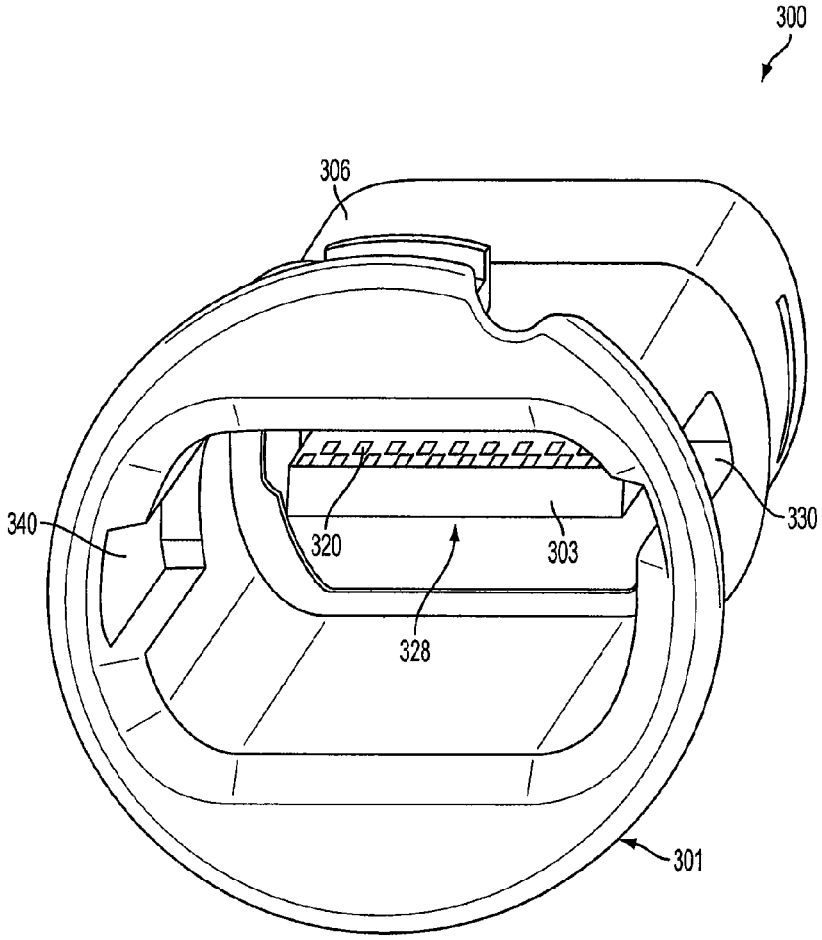
FIG. 3 is an interior perspective view of a mating end of a receptacle assembly of an electrical connector according to an embodiment of the invention.

FIG. 3 provides an interior perspective view of a mating end 301 of a receptacle assembly 300 in an unmated configuration. The receptacle assembly 300 includes a receptacle body 306 that is coupled to a receptacle PCB 303. The receptacle assembly 300, the receptacle body 306 or the receptacle PCB 303 may be the same or similar to the receptacle assembly 200, the receptacle body 206 or the receptacle PCB 203, respectively, previously discussed for FIG. 2. A plurality of conductive contact pads 320 are disposed on a mating portion or end 328 of the receptacle PCB 303. When utilized with a connected electrical system or device, each of the plurality of conductive contact pads 320 may be electrically connected with a plurality of cables, wires or other conductors (not shown) at an opposing end of the receptacle assembly 300 via electrical traces or pathways of the receptacle PCB 303, as discussed in greater detail above in FIG. 2. When mated with a plug assembly, as discussed in greater detail herein, the plurality of contact pads 320 engage with corresponding conductive elements of the plug assembly to establish an electrical connection therebetween.

The plurality of contact pads 320 may have a rectangular shape as shown or, in an alternative embodiment, may incorporate any shape sufficient to create an adequate or desired electrical connection when mated, as discussed in greater detail herein. Different shapes may exhibit varying degrees of conductive effectiveness when mating with components of a plug assembly and may have varying manufacturing costs. The plurality of contact pads 320 are positioned in an adjacent and staggered configuration on a surface of the receptacle PCB 303. For example, a first row of the plurality of contact pads 320 may be disposed in front of a second row of the plurality of contact pads 320, forming a checkerboard configuration. Moreover, the plurality of contact pads 320 may be positioned in the staggered configuration on both a first (e.g., top) surface and a second (e.g., bottom) surface of the receptacle PCB 303 in order to further increase the number of individual contact pads as part of the receptacle assembly 300. In an alternative embodiment, the plurality of contact pads 320 may be disposed on any number of surfaces of the receptacle PCB 303 (e.g., including side surfaces). The staggered configuration or the placement upon multiple surfaces of the receptacle PCB 303 may also reduce electrical interference or coupling that can occur when electrical signals propagate in close proximity to one another. An alternative embodiment may position greater or fewer contact pads upon the same or different areas or surfaces of the receptacle PCB 303.

A first keying slot 330 is formed in one portion of the receptacle body 306. In addition, a second keying slot 340 is also formed in a different portion (e.g., on an opposite side) of the receptacle body 306. The first and second keying slots (330, 340) help ensure that the receptacle assembly 300 may mate with a corresponding plug assembly in only one particular or predetermined orientation. Thus, a user cannot inadvertently connect a particular contact pad 320 on the receptacle PCB 303 with an unintended conductive element of the corresponding plug assembly. Electrical safety and connector reliability is therefore heightened by providing a fool-proof connection for users wherein the two assemblies cannot be misconnected. In an alternative embodiment, any keying elements may be used and in greater or fewer amounts than the two keying slots (330, 340) shown in FIG. 3. For example, an alternative embodiment may utilize a single protrusion positioned on the receptacle assembly 300 instead of a plurality of slots. In another example, the shape of the mating end 301 of the receptacle assembly 300 may be configured to only allow connection with a corresponding plug element in a single orientation.

Figure 4:
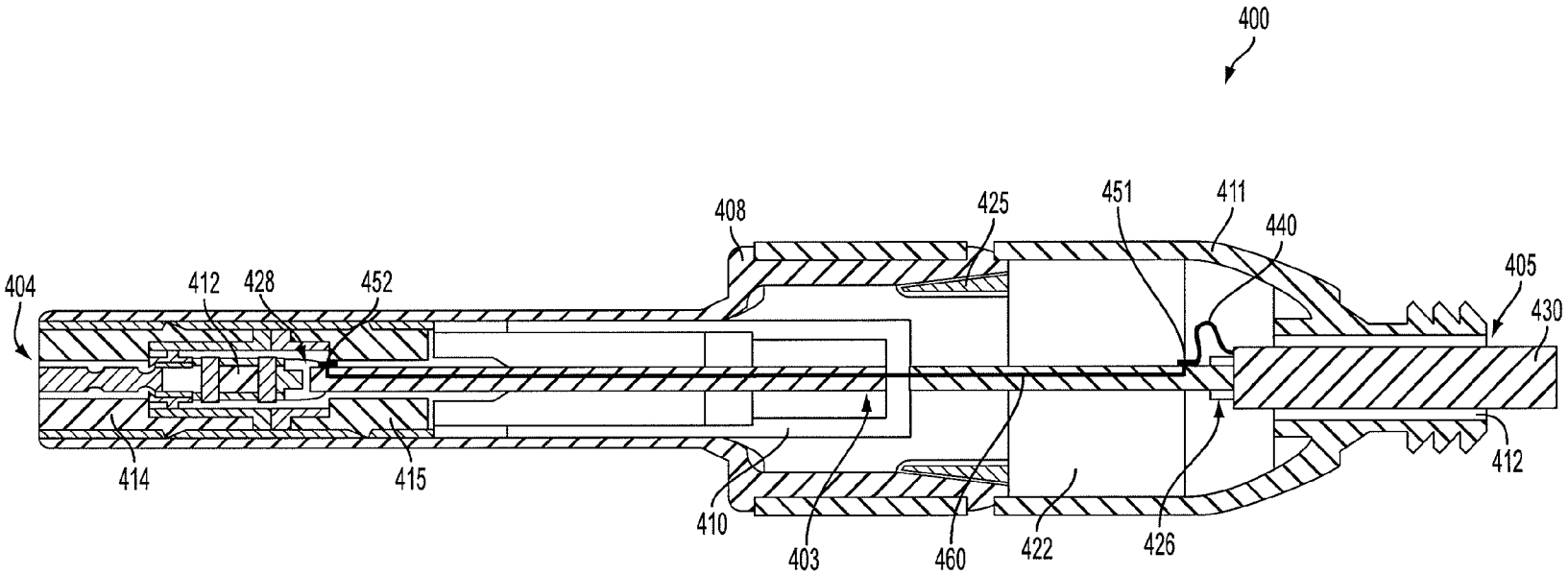
FIG. 4 is an enlarged cut-away side view of a plug assembly of an electrical connector according to an embodiment of the invention.

Referring next to FIG. 4, an enlarged cut-away side view of a plug assembly 400 of an electrical connector is shown. The plug assembly 400 may be the same or similar to the plug assembly 104 previously described for FIG. 1. Similar to the receptacle assembly 200 (see FIG. 2), the plug assembly 400 includes a plug housing 411 defining a cavity 422 therein and having a mating end 404 and a cable end 405 on an opposite side of the mating end 404. A plug body 408 is coupled to the plug housing 411 and is at least partially disposed within the cavity 422 of the plug housing 411. The plug body 408 may couple with the plug housing 411 via a protruding element 425 on the plug body 408 that snaps or otherwise engages with a receiving slot or opening of the plug housing 411. The plug body 408 is configured to connect with various connector components, as described in greater detail herein, for holding or positioning the various connector components within the cavity 422 of the plug housing 411.

The plug housing 411 may be made of a metal (e.g., stainless steel) while the plug body 408 may be made of a plastic, rubber or other non-conductive material. In an alternative embodiment, any of a variety of materials may be used for either the plug housing 411 or the plug body 408. The various connector components may be connected directly to the plug body 408 and disposed within the cavity 422 of the plug housing 411 to form a stable unit having the plug housing 411 as an outer shell, as discussed in greater detail herein. In an alternative embodiment, no plug body 408 may be needed and the various connector components may instead be connected directly with the plug housing 411.

Similar to the receptacle assembly 200 (see FIG. 2), within the cavity 422 of the plug housing 411, a plug printed circuit board ("PCB") 403 is coupled with the plug body 408. The plug PCB 403 may be coupled with the plug body 408 and held in a stable position via a PCB holding member 410. The PCB holding member 410 latches or snaps into a portion of the plug body 408 and also stably fastens with the plug PCB 403. In an alternative embodiment, the plug PCB 403 may be held in place by any component that keeps the plug PCB 403 from unintentionally shifting position within the plug body 408. A portion of the plug body 408 itself may be used in place of or in addition to the PCB holding member 410 for stably holding the plug PCB 403, for example via clips, adhesives, or any other type of mechanical connection exhibiting a firm hold on the plug PCB 403. Certain embodiments may provide varying degrees of stability at varying manufacturing costs.

The plug PCB 403 contains one or more conductive contact pads 451 disposed upon a surface of or near a cable portion or end 426 of the plug PCB 403. The plug PCB 403 also contains one or more corresponding conductive contact pads 452 disposed upon a surface of or near a mating portion or end 428 of the plug PCB 403. The contact pads 451, 452 at the two portions or ends 426, 428 are electrically connected with each other via conductive traces or pathways 460 extending along or through the plug PCB 403. Thus, a conductive pathway 460 is established from the one or more conductive pads 451 on the cable portion or end 426 to the corresponding one or more conductive pads 452 on the mating portion or end 428 of the plug PCB 403. In one embodiment, the plug PCB 403 may be a duplicate of a circuit board used in a receptacle assembly configured to mate with the plug assembly 400. Using the duplicate or same type of circuit board in both of the mated pair assemblies may allow for cheaper manufacturing due to the sharing of common parts therebetween.

The plug housing 411 also includes an opening 412 at the cable end 405. The opening 412 may be the same or similar to the opening 112 of FIG. 1. A plug cable bundle 430 is allowed to enter the opening 412 and thus pass into the cavity 422 of the plug housing 411. The plug cable bundle 430 may include a plurality of cables, wires or other conductors or may only include one cable, wire or other conductor. The opening 412 may be manufactured with a variety of sizes or shapes (e.g. circular) so long as a cross-sectional area of the opening 412 is sufficient to permit the desired plug cable bundle 430 to pass through the opening 412 and into the plug housing 411.

Once within the cavity 422 of the plug housing 411, the plug cable bundle 430 is electrically connected to the plug PCB 403 also positioned within the cavity 422. Conductive portions of the cable bundle 430 are connected 440 (e.g., soldered) to the conductive contact pads 451 on the cable portion or end 426 of the plug PCB 403. Thus, via the electrical traces or pathways 460 of the plug PCB 403, as discussed above, the plug cable bundle 430 is also electrically connected to the conductive contact pads 452 on the mating portion or end 428 of the plug PCB 403. In an alternative embodiment, other connection methods may be utilized for establishing an electrical pathway between the plug cable bundle 430 and the cable end 426 of the plug PCB 403. For example, the plug cable bundle 430 may be crimped or twisted with one or more conductor elements that extend towards the plug cable bundle 430 from the plug PCB 403. Varying electrical connection methods may have varying electrical efficiencies, manufacturing costs, or eases of assembly.

To help facilitate an electrical connection of the contact pads 452 on the mating portion or end 428 of the plug PCB 403 with contact pads 252 on a mating portion or end of a receptacle PCB (e.g., the contact pads 320 of FIG. 3) a plurality of contact modules 412 are coupled with the plug body 408 and positioned near the mating portion or end 428 of the plug PCB 403 and mating end 404 of the plug assembly 400. As discussed in greater detail below, each of the plurality of contact modules 412 includes a plurality of conductive contacts that provide a detachable (e.g., slidable) coupling between the plug PCB 403 and a receptacle PCB (e.g., the receptacle PCB 203 of FIG. 2) when the plug assembly 400 is mated with a corresponding receptacle assembly (e.g., the receptacle assembly 200 of FIG. 2). In an alternative embodiment, only one contact module 412 may be necessary or only one conductive contact may be used in the contact module 412. In yet another alternative embodiment, a conductive contact may be configured to interface the plug PCB 403 with a receptacle PCB without use of a contact module 412 for coupling the conductive contact with the plug assembly 400.

A first end of each of the plurality of conductive contacts of the plurality of contact modules 412 engages with and makes an electrical connection with a contact pad 452 on the mating portion or end 428 of the plug PCB 403. A second end of each of the plurality of conductive contacts of the plurality of contact modules 412 is configured to engage with and establish an electrical connection with a contact pad 252 on a mating portion or end of a receptacle PCB (e.g., one of the plurality of contact pads 320 of FIG. 3) when the plug assembly 400 is mated with a corresponding receptacle assembly. Thus, when mated, electrical signals from the plug cable bundle 430 may be propagated or transmitted through the plug PCB 403, through the plurality of contacts in the plurality of contact modules 412 and to a receptacle PCB for connection with cables, wires or other conductors connected with the receptacle PCB.

To help facilitate an electrical connection of the contact pads on the mating portion or end 428 of the plug PCB 403 with contact pads on a mating portion or end of a receptacle PCB (e.g., the contact pads 320 of FIG. 3) a plurality of contact modules 412 are coupled with the plug body 408 and positioned near the mating portion or end 428 of the plug PCB 403 and mating end 404 of the plug assembly 400. As discussed in greater detail below, each of the plurality of contact modules 412 includes a plurality of conductive contacts that provide a detachable (e.g., slidable) coupling between the plug PCB 403 and a receptacle PCB (e.g., the receptacle PCB 203 of FIG. 2) when the plug assembly 400 is mated with a corresponding receptacle assembly (e.g., the receptacle assembly 200 of FIG. 2). In an alternative embodiment, only one contact module 412 may be necessary or only one conductive contact may be used in the contact module 412. In yet another alternative embodiment, a conductive contact may be configured to interface the plug PCB 403 with a receptacle PCB without use of a contact module 412 for coupling the conductive contact with the plug assembly 400.

A first end of each of the plurality of conductive contacts of the plurality of contact modules 412 engages with and makes an electrical connection with a contact pad on the mating portion or end 428 of the plug PCB 403. A second end of each of the plurality of conductive contacts of the plurality of contact modules 412 is configured to engage with and establish an electrical connection with a contact pad on a mating portion or end of a receptacle PCB (e.g., one of the plurality of contact pads 320 of FIG. 3) when the plug assembly 400 is mated with a corresponding receptacle assembly. Thus, when mated, electrical signals from the plug cable bundle 430 may be propagated or transmitted through the plug PCB 403, through the plurality of contacts in the plurality of contact modules 412 and to a receptacle PCB for connection with cables, wires or other conductors connected with the receptacle PCB.

Likewise, electrical signals may also be propagated or transmitted in the opposite direction from cables, wires or other conductors connected with a receptacle PCB, through the receptacle PCB, through the plurality of contacts in the plurality of contact modules 412, through the plug PCB 403, and finally to the plug cable bundle 430. Alternative embodiments may be used for electrically connecting the plug cable bundle 430 to the plurality of contacts of the contact modules 412, for example by directly connecting the plurality of contacts to the plug cable bundle 430 without use of the plug PCB 403. Certain embodiments may benefit from lower manufacturing or component cost, but at decreased stability or ease-of-use.

The plurality of contact modules 412 are secured with the plug body 408 by a first module holder 414 and a second module holder 415. The first and second module holders (414, 415) lock or engage with the plurality of contact modules 412 and also with the plug body 408 in order to form a stable unit near the mating end 404 of the plug assembly 400. The first and second module holders (414, 415) also help position or properly align the plurality of contacts of the plurality of contact modules 412 to mate with the plug PCB 403 or desired components of a corresponding receptacle assembly. The first and second module holders (414, 415) may also be coupled with the PCB holding member 410 for further aiding in the stability or alignment of the plurality of contact modules 412.

In addition, the first and second module holders (414, 415), the PCB holding member 410, the plurality of contact modules 412 and the plug PCB 403 may be assembled separate from the plug body 408 as a stable unit. This stable unit can then be subsequently inserted into the plug body 408 wherein the PCB holding member 410 and/or the first and second module holders (414, 415) locks with a portion of the plug body 408 to secure all the components in a desired or predetermined position. In an alternative embodiment, other manners of securing the components in a desired position may be used. For example, greater or fewer numbers of module holders (e.g., only one module holder) may be utilized or the plug body 408 may itself hold the plurality of contact modules 412 in place without any additional module holders.

Figure 5:
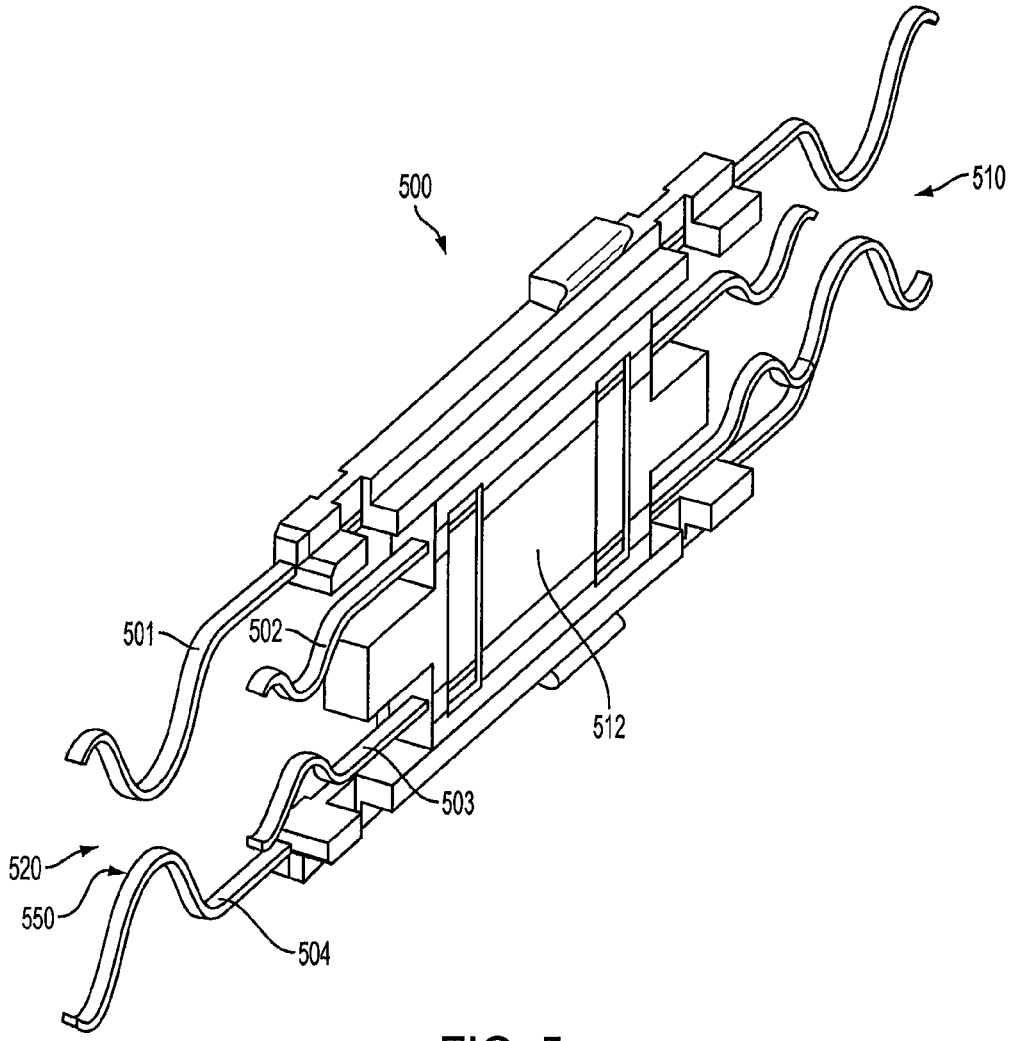
FIG. 5 is a perspective view of a contact module of an electrical connector according to an embodiment of the invention.

FIG. 5 is a perspective view of a contact module 500 for an electrical connector. The contact module 500 may be the same or similar to one of the plurality of contact modules 412 of FIG. 4. As shown, the contact module 500 includes four conductive contacts (501, 502, 503, 504). In an alternative embodiment, any number of conductive contacts may be utilized as part of the contact module 500. Each of the four conductive contacts (501, 502, 503, 504) extends from a first end 510 to a second end 520 of the contact module 500. The first end 510 of each of the four conductive contacts (501, 502, 503, 504) may be configured to couple to a PCB disposed adjacent to the contact module 500 within the same assembly as the contact module 500 (e.g., the plug PCB 403 in the plug assembly 400 of FIG. 4). The second end 520 of each of the four conductive contacts (501, 502, 503, 504) may be configured to extend outwardly from the assembly containing the contact module 500, for example to connect with a PCB disposed in a separate, mating assembly (e.g., the receptacle PCB 203 in the receptacle assembly 200 of FIG. 2).

Each of the four conductive contacts (501, 502, 503, 504) are maintained in their relative positions to one another by a holding element 512 coupled to a middle or central portion of each of the contacts. The holding element 512 holds each of the four conductive contacts (501, 502, 503, 504) of the contact module 500 at predetermined positions with respect to one another. The holding element 512 may be any non-conductive material (e.g., plastic) and includes a fastening mechanism that snaps to or otherwise secures (e.g., by an adhesive or friction) the four conductive contacts (501, 502, 503, 504) into a desired orientation or configuration. In addition, the holding element 512 also includes a securing mechanism for snapping or otherwise securing the contact module 500 with one or more other components of the electrical connector (e.g., snapping with the first module holder 414 and/or the second module holder 415 of FIG. 4).

Each of the four conductive contacts (501, 502, 503, 504) has at least one curved portion or segment 550 disposed along its length and configured to make an electrical connection with a contact pad on a printed circuit board. The curved portion 550 of each of the four conductive contacts (501, 502, 503, 504) is thus configured to correspond or align with a contact pad on a PCB that slides into contact with or is otherwise disposed adjacent to the four conductive contacts (501, 502, 503, 504). The PCB may be secured to one or more of the four conductive contacts (501, 502, 503, 504), for example via solder, or may be held in place with one or more of the four conductive contacts (501, 502, 503, 504) due to friction alone. Thus, a contact pad on the PCB will press against a corresponding curved portion 550 of one of the four conductive contacts (501, 502, 503, 504), permitting an electrical signal that is present on the contact pad to propagate to the one of the four conductive contacts (501, 502, 503, 504) and vice versa.

The curved portions 550 of the four conductive contacts (501, 502, 503, 504) are shaped or configured to allow wiping with the contact pad. The curved portions 550 of the four conductive contacts (501, 502, 503, 504) may be of any suitable shape or configuration such that electrical signals can be sufficiently transferred between the four conductive contacts (501, 502, 503, 504) and the contact pad on a corresponding PCB. For example, the curved portion 550 may exhibit a smooth, curved shape as it changes direction or may make abrupt changes in direction, such as with a crimp.

As shown, the four conductive contacts (501, 502, 503, 504) of the contact module 500 are placed in a staggered and mirrored configuration. For example, the first conductive contacts 501 and the fourth conductive contact 504 may be arranged substantially in a first plane wherein the fourth conductive contact 504 is positioned beneath and opposite or inverted in orientation from the first conductive contact 501. Similarly, the second conductive contact 502 and the third conductive contact 503 may be arranged substantially in a second plane parallel to the first plane and wherein the third conductive contact 503 is positioned beneath and opposite or inverted in orientation from the second conductive contact 502. The first and the second conductive contacts (501, 502) may be upper conductive contacts and the third and fourth conductive contacts (503, 504) may be lower conductive contacts. Thus, a PCB with corresponding contact pads positioned on both an upper surface and a lower surface of the PCB is permitted to fit between the upper and lower conductive contacts and engage with the curved portions 550 of each of the four conductive contacts (501, 502, 503, 504). The contact pads on the upper surface of the PCB can electrically connect with the upper conductive contacts (501, 502) and the contact pads on the lower surface of the PCB can electrically connect with the lower conductive contacts (503, 504).

Figure 6:
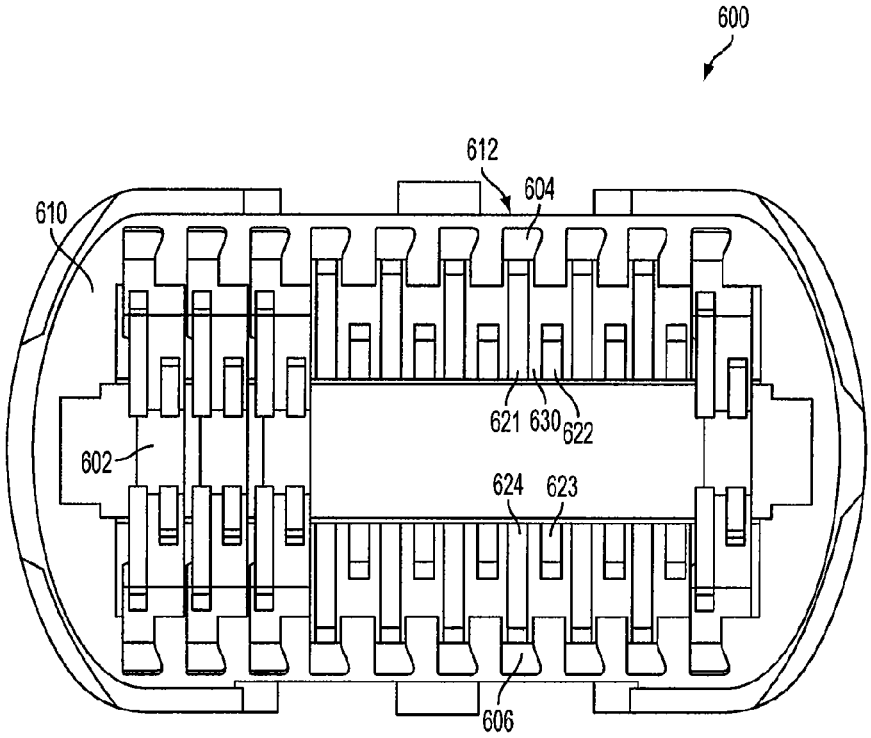
FIG. 6 is a front view of a module holder of an electrical connector with an associated contact module according to an embodiment of the invention.

FIG. 6 shows a front view of a module holder 600 of an electrical connector holding an associated contact module 602 therein. The module holder 600 may be the same or similar to the first module holder 414 or the second module holder 415, previously discussed for FIG. 4. The module holder 600 includes a base 610 (e.g., made from a plastic material) that defines a plurality of parallel openings 612. Each of the openings 612 extends parallel to one another from one end of the base 610 to the other. Each of the openings 612 is also configured to receive and engage with a contact module 602 having one or more conductive contacts coupled therein (e.g., the contact module 500 of FIG. 5). As shown, ten openings 612 are displayed in the module holder 600, therefore, the module holder 600 is capable of holding a maximum of ten total contact modules 602. The contact module 600 is shown only partially populated, however, with three contact modules engaged with the left-most three openings and a fourth contact module located in the right-most opening. In an alternative embodiment, greater or fewer openings may be utilized for holding varying numbers of contact modules.

Each of the openings 612 in the base 610 of the module holder 600 includes an upper slot 604 and a lower slot 606. Each contact module 602 is thus configured to slide or fit into both the upper slot 604 and the corresponding lower slot 606 when received in the opening 612. The contact module 602 may snap in place when appropriately or fully inserted into the opening 612. In an alternative embodiment, the contact module 602 may secure or engage with the module holder 600 by any of a variety of other mechanical connections (e.g., adhesives). Thus, in a fully populated module holder 600, ten contact modules 602 will be disposed in a parallel arrangement in the ten openings 612 of the base 610.

In addition to the upper slot 604 and the lower slot 606, a first contact pocket 621, a second contact pocket 622, a third contact pocket 623 and a fourth contact pocket 624 are disposed in the base 610 for each of the plurality of openings 612. Each of the four contact pockets (621, 622, 623, 624) is configured to receive a conductive contact of an associated contact module 602 when the contact module 602 is engaged or positioned in the opening 612. The contact pockets (621, 622, 623, 624) are formed or defined by a plurality of walls or ribs 630 that operate to separate or isolate the conductive contacts of the contact module 602 from one another within the base 610. Thus, when the contact module 602 is positioned into the one of the openings 612, each conductive contact of the contact module 602 is accepted into one of the four contact pockets (621, 622, 623, 624).

Figure 7:
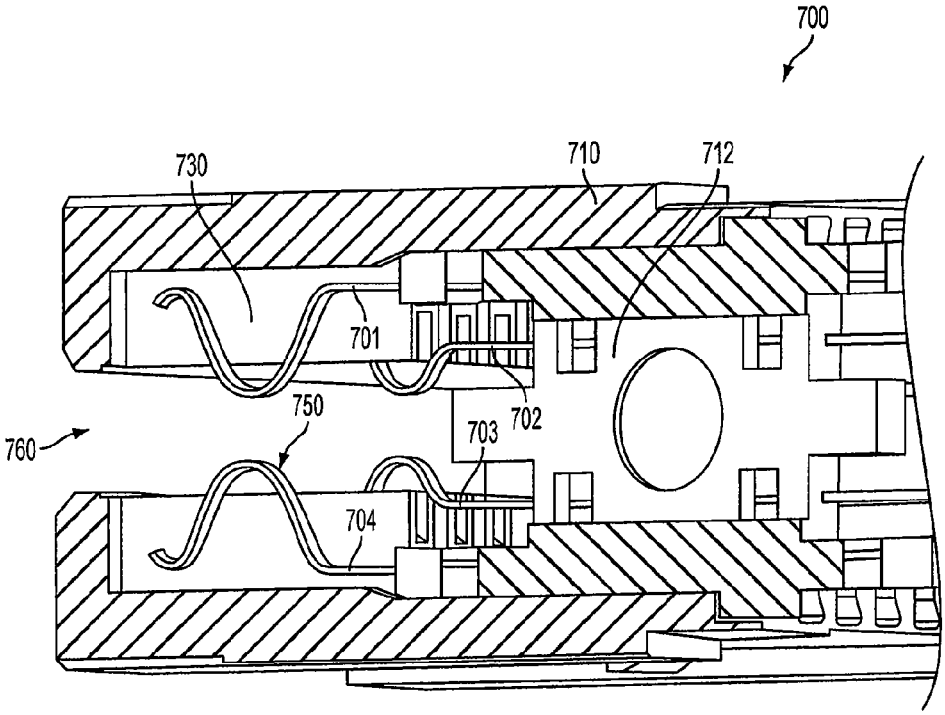
FIG. 7 is a cut-away perspective view of a module holder of an electrical connector containing an associated contact module according to an embodiment of the invention.

FIG. 7 shows a cut-away perspective view of a module holder 700 of an electrical connector with an associated contact module 712. The module holder 700 includes a base 710 with a plurality of contact pockets formed therein. The module holder 700 having the base 710 may be the same or similar to the module holder 600 having the base 610 of FIG. 6. A plurality of walls or ribs 730 separate a plurality of contact pockets from each other, the same or similar to the walls or ribs 630 of FIG. 6. Thus, when the contact module 712 having a plurality of conductive contacts (701, 702, 703, 704) is received or engaged with the module holder 700, the same or similar as discussed above, each of the plurality of conductive contacts (701, 702, 703, 704) fits within a corresponding contact pocket and is isolated from the remaining conductive contacts. A curved portion 750 of each of the conductive contacts (701, 702, 703, 704) extends to an area outside of its respective contact pocket so that it may engage with a PCB disposed in an area 760 adjacent to the conductive contacts (701, 702, 703, 704).

Figure 8A:
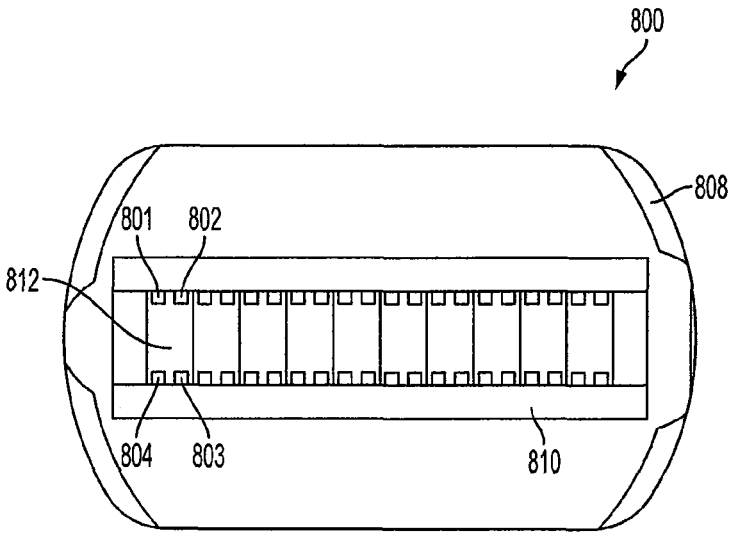
FIG. 8A is a front view of a mating end of a plug assembly of an electrical connector according to an embodiment of the invention.

FIG. 8A demonstrates a front view of the mating end of the plug assembly 800 and displays a plug body 808 incorporating a module holder 810 that is fully populated with ten contact modules 812, each contact module 812 including four conductive contacts (801, 802, 803, 804). Thus, forty total conductive contacts are coupled with the module holder 810 (i.e. four for each contact module 812) and are available to touch and electrically connect with forty contact pads of a corresponding PCB (e.g., the receptacle PCB 300 of FIG. 3) when the plug assembly 800 is mated with a corresponding receptacle assembly. The plug assembly 800 may be the same or similar to the plug assembly 400 of FIG. 4, the module holder 810 may be the same or similar to the module holder 600 of FIG. 6 and the contact module 812 may be the same or similar to the contact module 500 of FIG. 5.

Figure 8B:
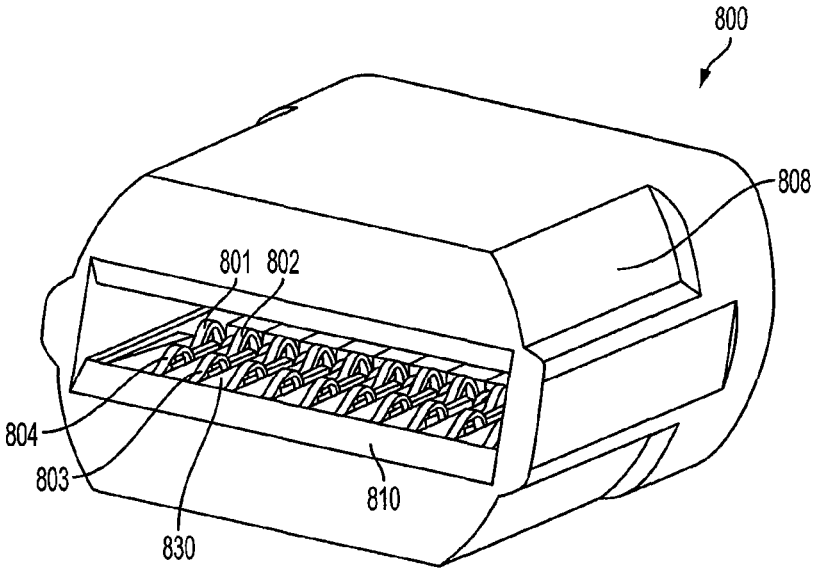
FIG. 8B is a perspective view of the mating end of the plug assembly of the electrical connector of FIG. 8A according to an embodiment of the invention.

FIG. 8B similarly demonstrates the mating end of the plug assembly 800 having the plug body 808 and the contact module holder 810 fully populated with ten contact modules, but from a perspective view. As can be seen, each conductive contact (801, 802, 803, 804) is separated or isolated from other contacts via walls or ribs 830. Certain walls or ribs 830 may be thicker than others. For example, conductors expected to carry higher power signals may be surrounded by walls or ribs 830 of greater thickness to better aid in reducing electrical interference or cross-talk. Twenty of the forty total conductive contacts are shown along a bottom portion of the contact module holder 810 while the remaining twenty of the forty total conductive contacts are disposed along a top portion and obscured from view.

Figure 9A:
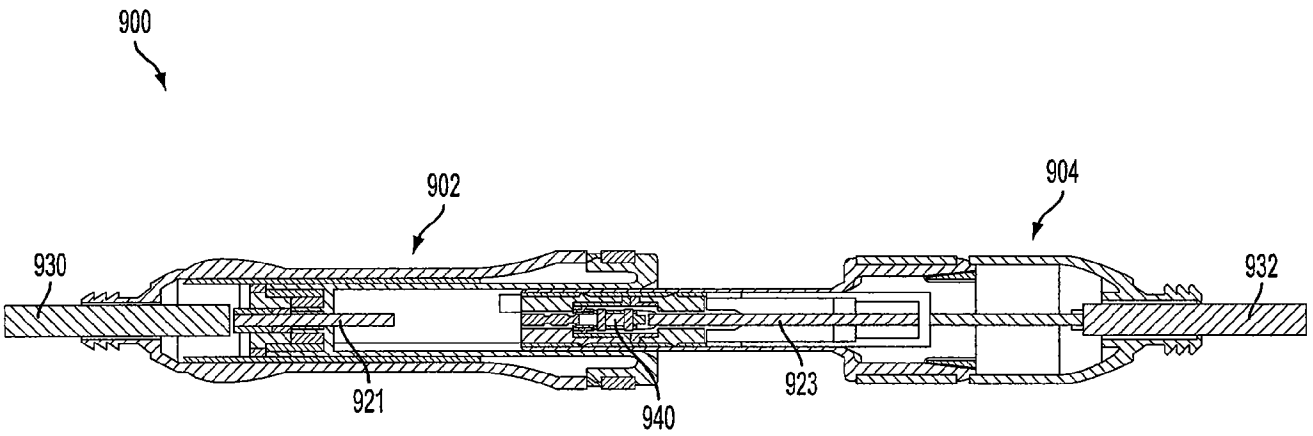
FIG. 9A is a cut-away side view of an electrical connector utilizing printed circuit boards during a mating process according to an embodiment of the invention.

Referring now to FIG. 9A, a cut-away side view of an electrical connector 900 utilizing printed circuit boards during a mating process is shown. The electrical connector 900 may be the same or similar to the electrical connector 100 of FIG. 1. A mating end of a plug assembly 904 is received by a mating end of a receptacle assembly 902. Keying elements or a latching system, as discussed in greater detail herein, may be used to ensure the plug assembly 904 and the receptacle assembly 902 are in the desired orientation with respect to each other before they are permitted to mate and fasten together. A plug PCB 923 disposed within a cavity of the plug assembly 904 is electrically connected with one or more contact modules 940 having one or more conductive contacts. When mating of the plug assembly 904 and the receptacle assembly 902 is complete, one or more of the conductive contacts of the contact modules 940 will establish a conductive pathway between the plug PCB 923 and a receptacle PCB 921. Thus, a plug cable bundle 932 may be electrically connected with a receptacle cable bundle 930 via the electrical connector 900.

Figure 9B:
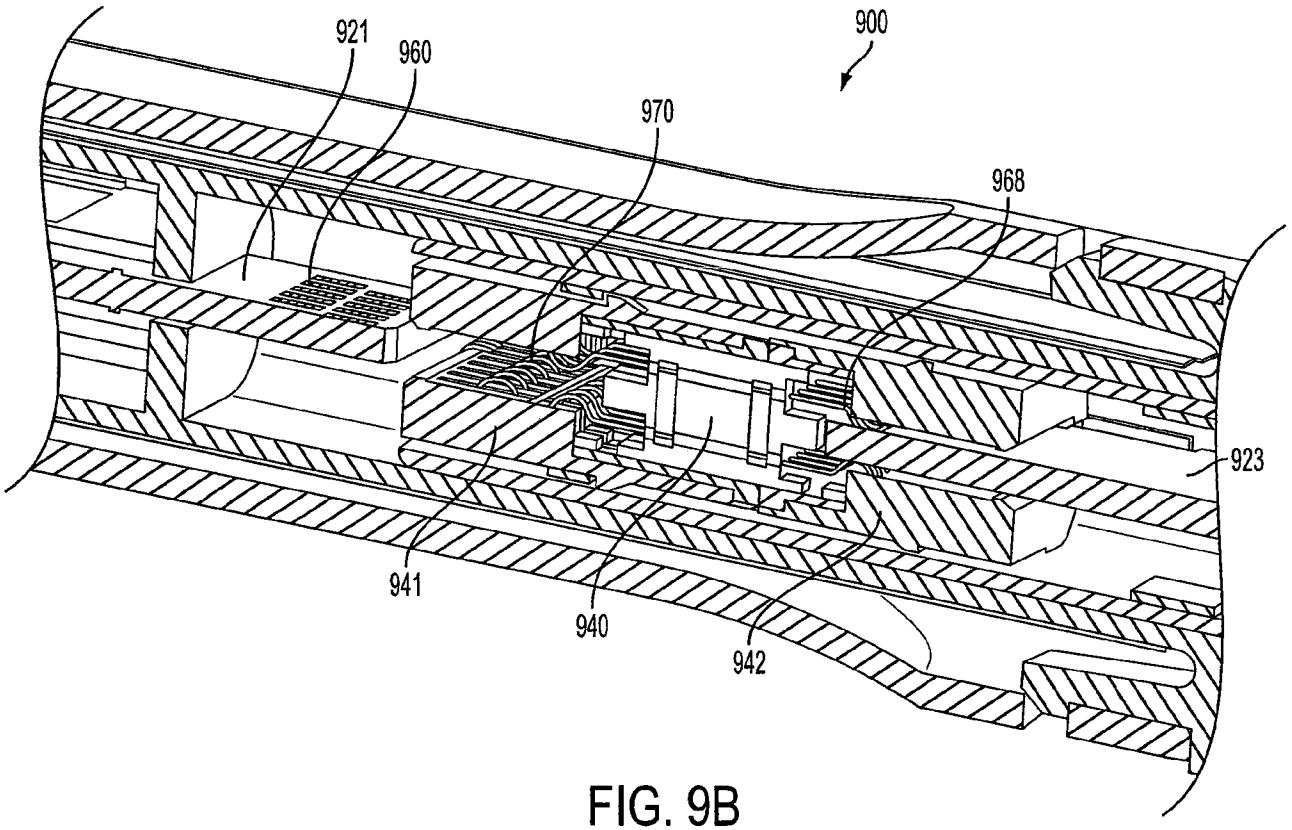
FIG. 9B is an enlarged cut-away perspective view of the electrical connector of FIG. 9A during the mating process according to an embodiment of the invention.

FIG. 9B shows a cut-away perspective view of the electrical connector 900 of FIG. 9A during the mating process. As shown, the plug PCB 923 is electrically connected with a plurality of conductive contacts 968 of the plurality of contact modules 940. The plurality of contact modules 940 are positioned and secured within the plug assembly 904 of the electrical connector 900 via a first contact module holder 941 and a second contact module holder 942. The receptacle PCB 921 includes a plurality of conductive pads 960 disposed upon one or more surfaces of the receptacle PCB 921.

During the mating process, the receptacle PCB 921 is received between upper and lower portions of the first contact module holder 941 and the plurality of conductive pads 960 are engaged by the plurality of conductive contacts 970 extending therefrom. Staggering and positioning of the plurality of contact pads 960 on a top and a bottom surface of the receptacle PCB 921 allows for a large number of electrical connections to be made by the electrical connector 900. In an alternative embodiment, the plurality of contact pads 960 may not be staggered or may be positioned on greater or fewer surfaces of the receptacle PCB 921.

Figure 10A:
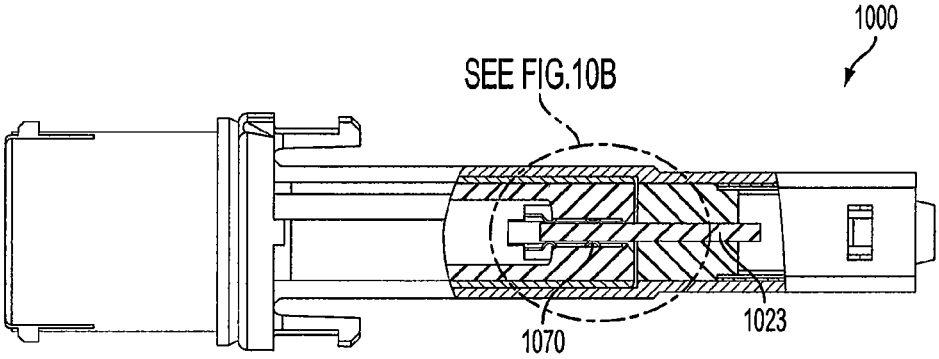
FIG. 10A is a side view of an electrical connector utilizing printed circuit boards when in a mated configuration according to an embodiment of the invention.
Figure 10B:
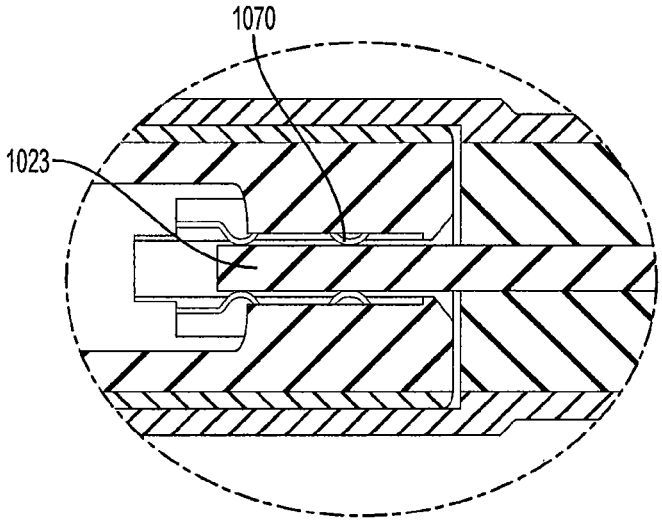
FIG. 10B is an enlarged side view of the electrical connector of FIG. 10A when in a mated configuration according to an embodiment of the invention.

FIG. 10A shows a side view of a mated configuration for an electrical connector 1000 utilizing printed circuit boards when the mating process has completed while FIG. 10B shows an enlarged view of the mated configuration for the electrical connector 1000 of FIG. 10A. The electrical connector 1000 may be the same or similar to the electrical connector 900 of FIGS. 9A and 9B. As seen, a curved portion of a plurality of contacts 1070 have engaged with a plurality of contact pads positioned on a top surface and a bottom surface of a PCB 1023 in order to establish an electrical connection therebetween.

Figure 11:
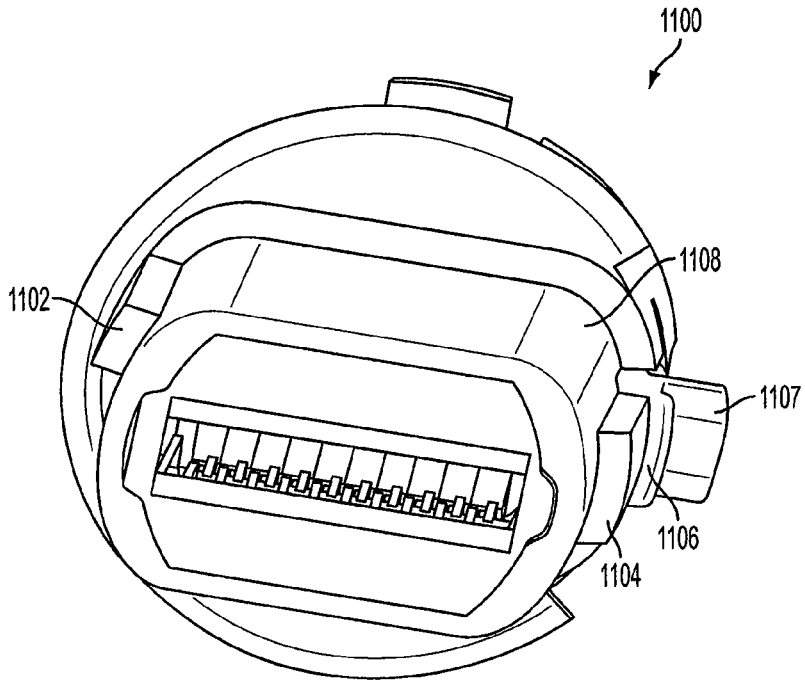
FIG. 11 is a perspective view of a mating end of a plug assembly of an electrical connector with keying and latching components according to an embodiment of the invention.

Referring lastly to FIG. 11, a perspective view of a mating end of a plug assembly 1100 of an electrical connector is shown to demonstrate its keying and latching abilities. A plug body 1108 contains keying protrusions or elements 1102 and 1104 for ensuring the plug body 1108 of the plug assembly 1100 is in the proper orientation with respect to a corresponding receptacle assembly for proper mating. The corresponding receptacle assembly may thus include keying slots (e.g., the keying slots 330 and 340 shown in FIG. 3) for receiving or accepting the keying protrusions (1102, 1104). If the keying protrusions (1102, 1104) are not appropriately orientated with the keying slots of a corresponding receptacle assembly, the plug assembly and the corresponding receptacle assembly will not mate together.

Such keying can help reduce damage to a mated pair connector by preventing improper fastening of the mated pair connector together. In addition, keying also helps reduce risk of damage to electronics connected via the mated connector. Although FIG. 11 shows two keying elements (1102, 1104) being used, in an alternative embodiment, greater or fewer keying elements may be utilized. Moreover, in an alternative embodiment, keying may be accomplished in a variety of manners (e.g., via a shape of the mating ends of the plug and receptacle assemblies themselves).

In addition, a latching mechanism 1106 is also coupled with the plug body 1108 and operates to fasten or secure the plug assembly 1100 and a corresponding receptacle assembly together after mating has completed. Such latching can help ensure the mated pair connector does not unintentionally disconnect after the mating process has completed. Once the plug assembly 1100 is mated with the corresponding receptacle assembly, the latching mechanism 1106 on the plug body 1108 snaps or latches to a portion of the corresponding receptacle assembly. To disengage the plug assembly 1100 from the corresponding receptacle assembly, a disengagement button or element 1107 on the plug body 1108 can be pressed or otherwise manipulated to unlatch the latching mechanism 1106 from the portion of the corresponding receptacle assembly. Alternative embodiments may utilize other manners of fastening and disengagement, for example, threaded components that screw into place to ensure the plug assembly and the corresponding receptacle assembly do not decouple unintentionally.

Figure 12A:
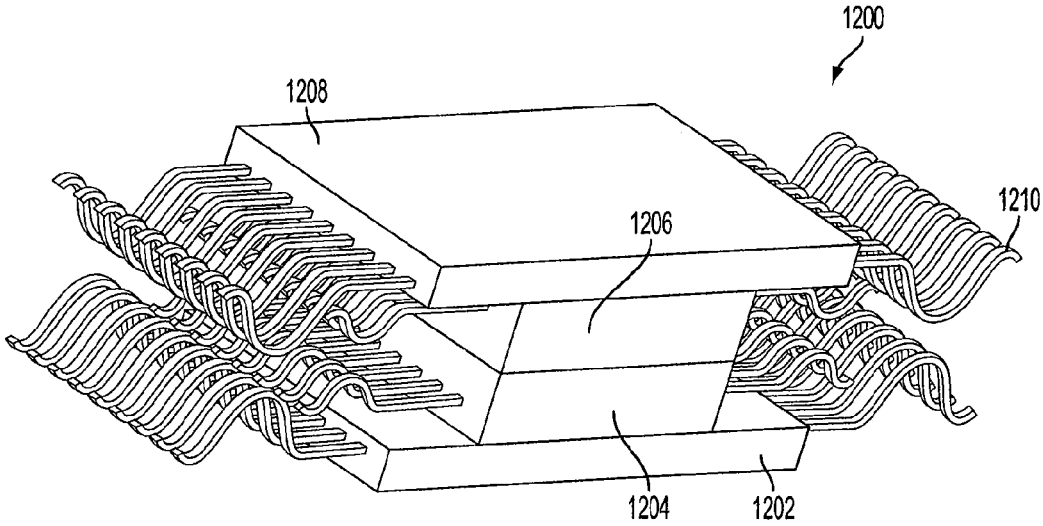
FIG. 12A is a perspective view of a contact module of an electrical connector according to an embodiment of the invention.

FIG. 12A shows an embodiment of a contact module 1200 for use in an electrical connector. Certain features of the contact module 1200 may be the same or similar to the contact module 500 previously described for FIG. 5. The contact module 1200, however, incorporates a plurality of wafers or platforms (1202, 1204, 1206, 1208) for holding a plurality of conductive contacts 1210. The contacts 1210 may be the same or similar to the conductive contacts (501, 502, 503, 504) previously described for FIG. 5. Thus, rather than a plurality of contact modules configured to slide within and engage in a parallel configuration with a module holder (see FIG. 5 and FIG. 6), the contact module 1200 is a stable block or stack securely fastening all of the contacts 1210 utilized in the electrical connector in position with one another. An electrical connector utilizing the contact module 1200 may be cheaper to manufacture due to fewer mechanical parts, but may provide less flexibility in modification or customization. In certain embodiments, the contacts 1210 of the contact module 1200 may be removably inserted within openings of the contact module 1200 to allow for increased modibility.

Figure 12B:
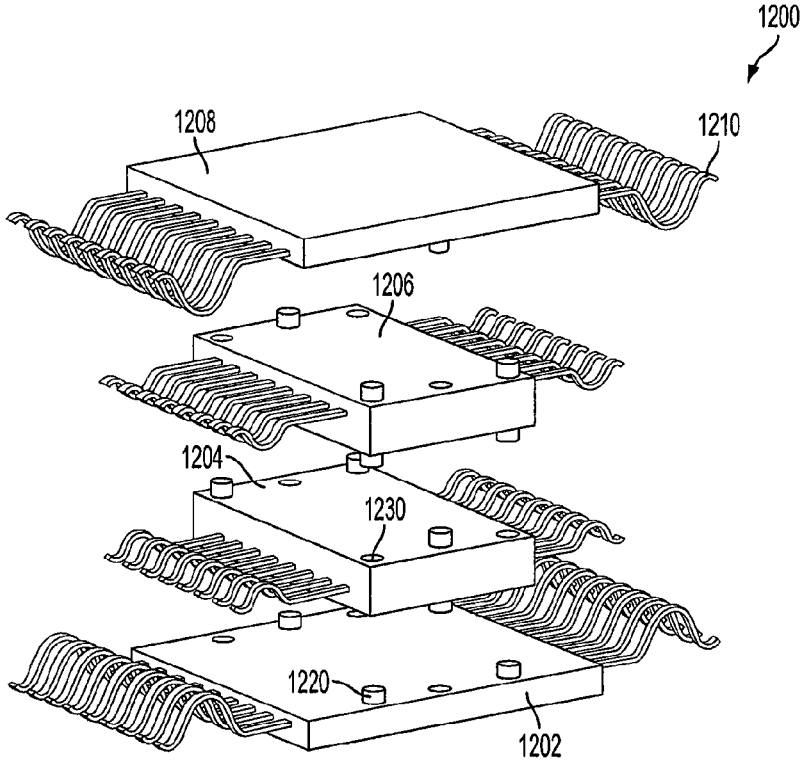
FIG. 12B is an exploded perspective view of the contact module of FIG. 12A of an electrical connector according to an embodiment of the invention.

FIG. 12B shows the contact module 1200 of FIG. 12A, but in an exploded configuration. Thus, the first wafer 1202 is shown separated from the second wafer 1204 which is shown separated from the third wafer 1206 which is shown separated from the fourth wafer 1208. A plurality of connecting protrusions 1220 and associated connecting holes 1230 are disposed on or within the four wafers (1202, 1204, 1206, 1208) for coupling the four wafers (1202, 1204, 1206, 1208) together to form a stable unit. The connecting protrusions 1220 may lock or press in place with the associated connecting holes 1230 and be held in place due to friction. In an alternative embodiment, additional, fewer or other fastening materials or manners may be utilized, for example adhesives, to couple the four wafers (1202, 1204, 1206, 1208) with one another.

Figure 13:
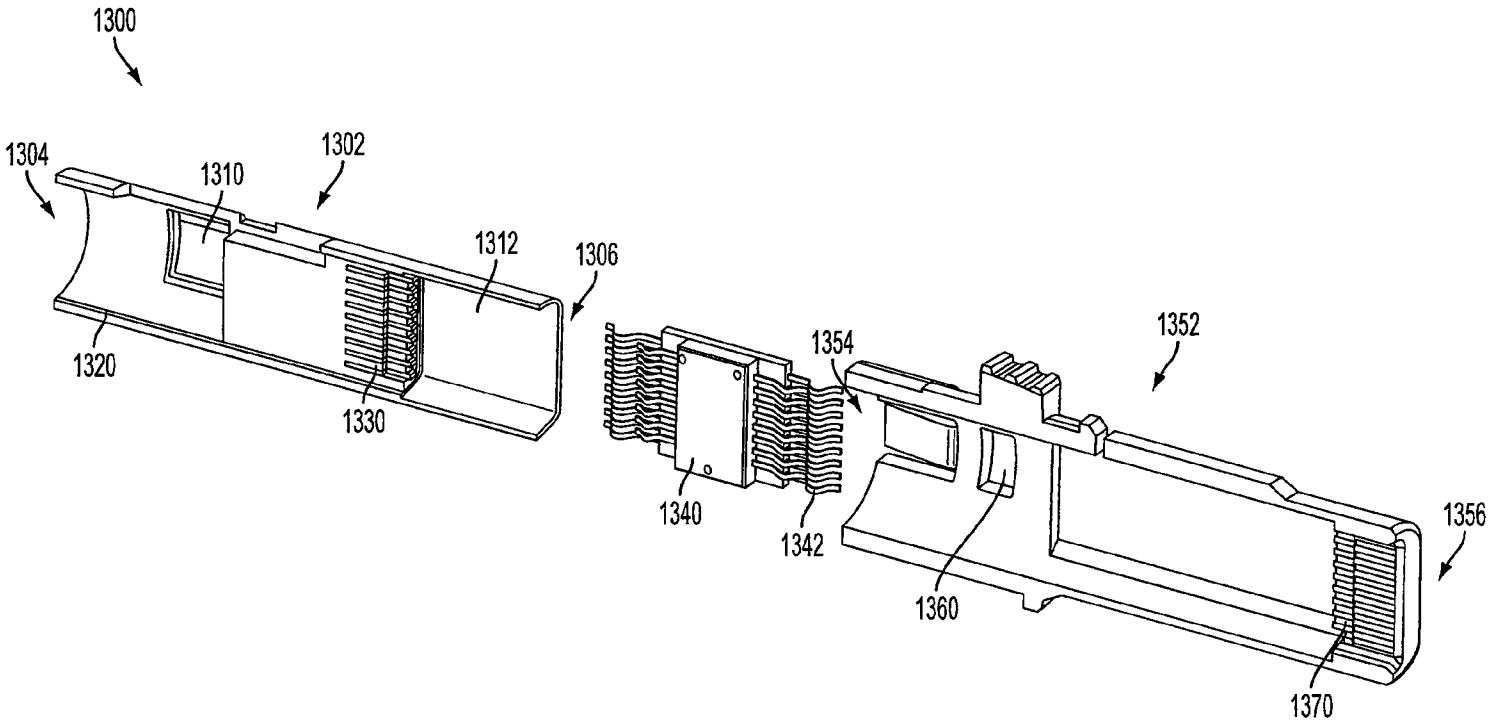
FIG. 13 is an exploded cut-away perspective view of a plug assembly of an electrical connector utilizing a contact module for connection with printed circuit boards according to an embodiment of the invention.

FIG. 13 shows an embodiment of a plug assembly 1300 of an electrical connector utilizing a contact module 1340. The contact module 1340 may be the same or similar to the contact module 1200 previously described for FIGS. 12A-B. Moreover, certain features of the plug assembly 1300 may be the same or similar to the plug assembly 400 previously described for FIG. 4. The plug assembly 1300 includes a plug body 1352, the contact module 1340 configured to fit within the plug body 1352, and a wafer carrier or contact module holder 1302 for securing the contact module 1340 in position within the plug body 1352. The wafer carrier 1302 may be manufactured or formed as a single component, thus providing for less expensive manufacturing costs, but at a potential loss in modability when compared to the separate first module holder 414, second module holder 415 and PCB holding member 410 previously described for FIG. 4. The plug assembly 1300 may also include a plug housing (not shown) that connects with the plug body 1352, the same or similar to the plug housing 411 previously described for FIG. 4.

As shown, the plug body 1352 has a mating end 1356 and a plurality of slots or contact pockets 1370 adjacent to the mating end 1356 for accepting a portion of the contacts 1342 of the contact module 1340 when the contact module 1340 is secured within the plug body 1352. Similarly, a plurality of slots or contact pockets 1330 are disposed near a mating end 1306 of the wafer carrier 1302 for accepting a portion of the contacts 1342 of the contact module 1340. A protective shroud 1312 extends beyond the plurality of slots or contact pockets 1330 of the wafer carrier 1302 in order to provide additional protection or support for the contact module 1340.

Figure 14:
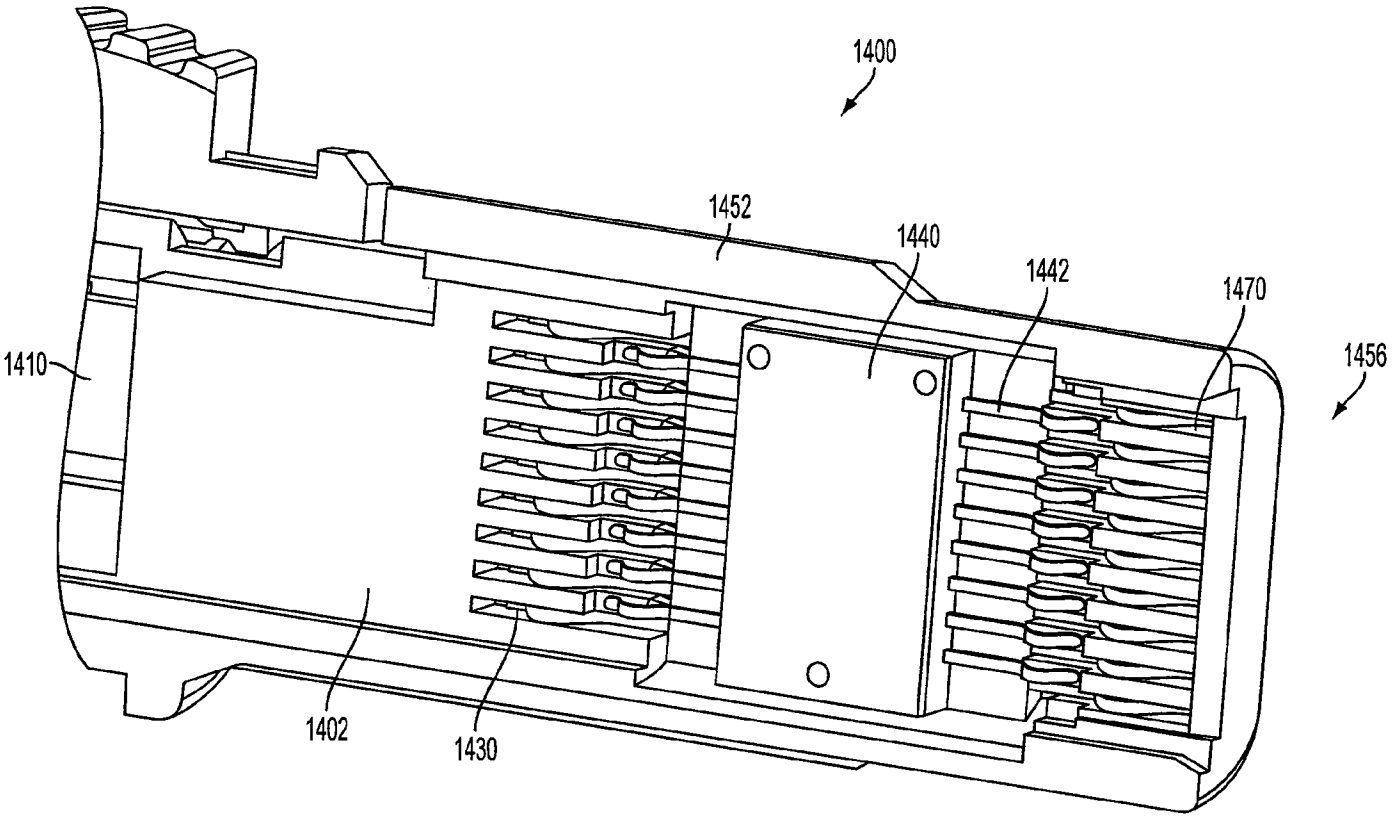
FIG. 14 is an enlarged cut-away perspective view of a plug assembly of an electrical connector utilizing a contact module for connection with printed circuit boards according to an embodiment of the invention.

The plug body 1352 also incorporates a cutout 1360 for engaging with a retention member 1310 of the wafer carrier 1302 in order to securably hold the plug body 1352, the contact module 1340 and the wafer carrier 1302 together as a stable unit. A PCB end 1354 of the plug body 1352 and a PCB end 1304 of the wafer carrier 1302 are configured to receive or accommodate a plug PCB (not shown) that slidably engages with a groove 1320 of the wafer carrier 1302 for electrical connection with one or more wires or conductive cables. Electrical contact pads on the plug PCB engage with a portion of the contacts 1342 of the contact module 1340, the same or similar as previously described for FIG. 4. FIG. 14 shows an enlarged cut-away perspective view of a plug assembly 1400 of an electrical connector utilizing a contact module 1440 disposed therein. The plug assembly 1400 may be the same or similar to the plug assembly 1300 previously described for FIG. 13.

As shown, a plug body 1452 having a mating end 1456 is engaged with a wafer carrier 1402 disposed therein and coupled with the contact module 1440 having a plurality of contacts 1442. The plurality of contacts 1442 are accepted by a plurality of corresponding slots or contact pockets 1470 in the plug body 1452 or a plurality of corresponding slots or contact pockets 1430 in the wafer carrier 1402, the same or similar as previously described for FIG. 13. The wafer carrier 1402 is engaged with the plug body 1452 via a retention member 1410 of the wafer carrier 1402 that snaps or otherwise engages with an opening or tab of the plug body 1452. A plug PCB (not shown) with conductive pads disposed thereon may thus be received within the wafer carrier 1402 and electrically connect with the contacts 1442 (i.e. the contacts 1442 shown on the left-hand side of the contact module 1440). Similarly, the contacts 1442 shown on the right-hand side of the contact module 1440 are configured to engage with and electrically connect with conductive pads of a receptacle PCB of receptacle assembly (not shown) when the plug assembly 1400 is mated with the receptacle assembly.

Figure 15:
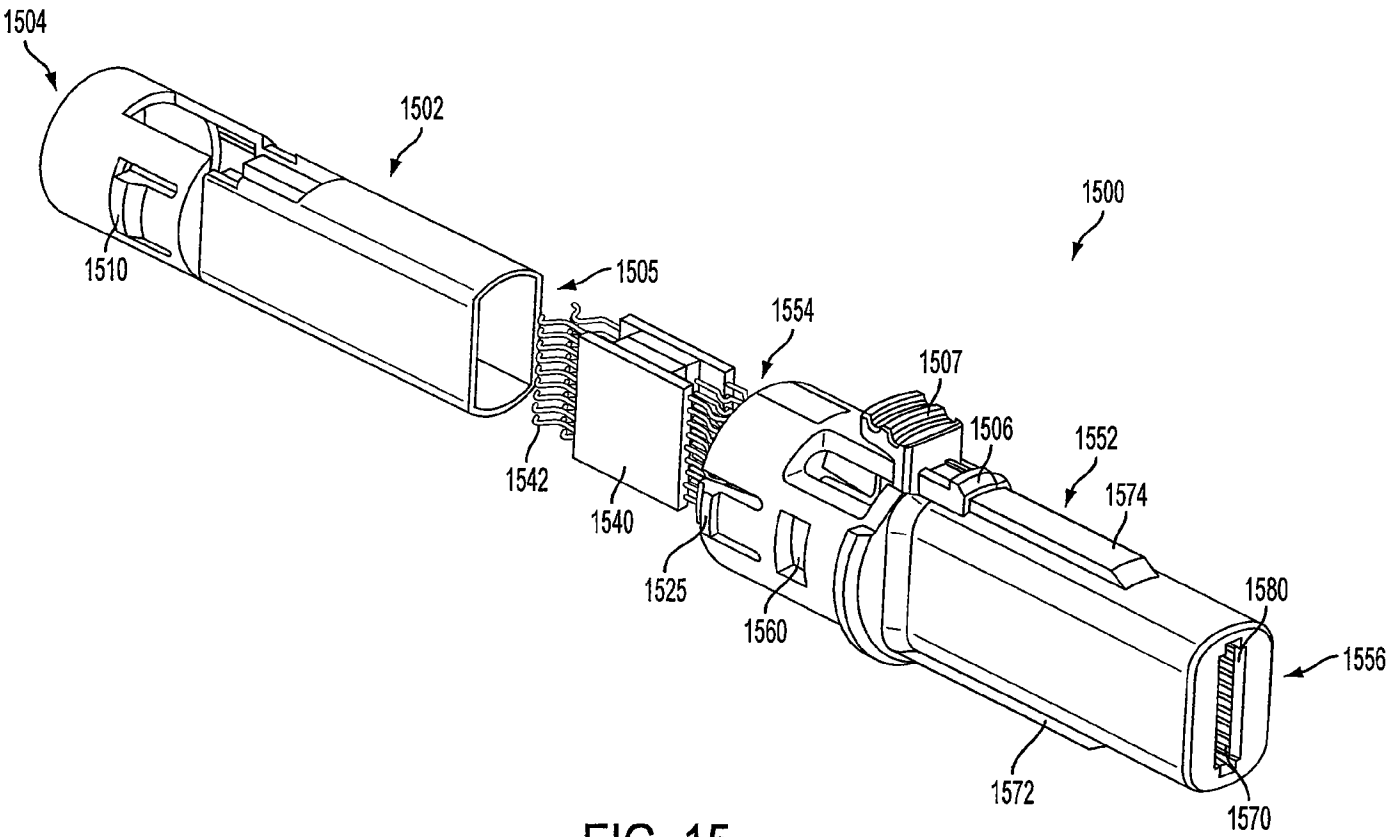
FIG. 15 is an exploded perspective view of a plug assembly of an electrical connector utilizing a contact module for connection with printed circuit boards according to an embodiment of the invention.

FIG. 15 shows an exploded perspective view of a plug assembly 1500 of an electrical connector utilizing a contact module 1540 for connection with printed circuit boards. The plug assembly 1500 may be the same or similar to the plug assembly 1400 of FIG. 14 or the plug assembly 1300 of FIG. 13. The plug assembly 1500 includes a plug body 1552, a contact module 1540 configured to fit within the plug body 1552, and a wafer carrier 1502 for securing the contact module 1540 in position within the plug body 1552. The plug body 1552 has a PCB end 1554 for receiving at least part of the wafer carrier 1502 and a mating end 1556 defining an opening 1580 providing access to one or more slots or contact pockets 1570, each slot or contact pocket 1570 configured to accept one of a plurality of contacts 1542 of the contact module 1540 when the contact module 1540 is disposed within the plug body 1552.

The contact module 1540 is coupled in place within the plug body 1552 via the wafer carrier 1502 having a mating end 1505, a PCB end 1504 and a retention member 1510 configured to engage with an opening 1560 of the plug body 1552, the same or similar as previously discussed. The plug body 1552 also includes a tab or attachment component 1525 for mechanically fastening with a plug housing (not shown), the same or similar as previously described. The plug body 1552 also includes a latching mechanism 1506, the same or similar to the latching mechanism 1106, and disengagement button or element 1507, the same or similar to the disengagement button or element 1107. In addition, the plug body 1552 includes a keying protrusion or element 1574 for ensuring the plug body 1552 of the plug assembly 1500 is in a proper orientation with respect to a corresponding receptacle assembly during mating, the same or similar as previously described for the keying protrusion 1104 of FIG. 11. Additional keying protrusions (e.g., a keying protrusion 1572) may be disposed on other surfaces of the plug body 1552. In an alternative embodiment, other methods of keying or fastening a plug assembly to a receptacle assembly, the same or similar as previously discussed.

Figure 16:
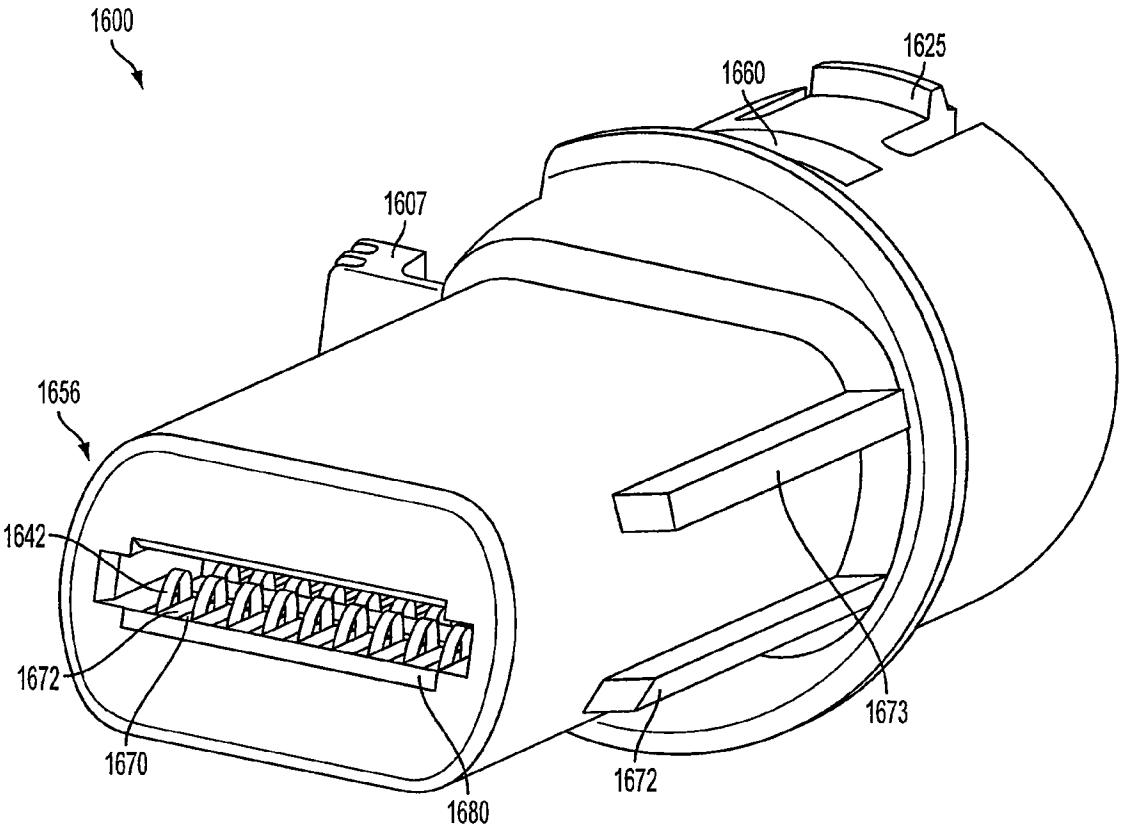
FIG. 16 is a perspective view of a mating end of a plug assembly of an electrical connector according to an embodiment of the invention.

FIG. 16 shows a perspective view of a mating end 1656 of a plug assembly 1600 of an electrical connector and illustrates a plurality of electrical contacts configured to electrical connect with one or more components of a corresponding a receptacle assembly. The plug assembly 1600 may be the same or similar to the plug assembly 1500 previously described for FIG. 15. The plug assembly 1600 includes keying protrusions 1672 and 1673, a disengagement button or element 1607 for releasing the plug assembly 1600 for a mated configuration with a corresponding receptacle assembly, an opening 1660 for coupling with a wafer carrier or module holder disposed within and an attachment component 1625 for coupling with a plug housing, the same or similar as previously described. A mating end 1656 is clearly seen having an opening 1680 for allowing a plurality of electrical contacts 1642 received by a plurality of slots or contact pockets 1670 formed via ribs 1672 to engage with one or more conductive elements of a receptacle assembly when mated with the plug assembly 1600.

Although the embodiments previously described have shown various connector components as integrated or coupled to a plug assembly or a receptacle assembly, the gender of each assembly may be reversed or certain features of the plug assembly may be incorporated into the receptacle assembly and vice versa in an alternative embodiment. An alternative embodiment may also utilize greater or fewer connector components than have been described for the embodiments above. In one example, electrical contacts, contact modules, and/or contact module holders may be incorporated as part of a receptacle connector assembly and be configured to slidably mate with a printed circuit board of a plug assembly. In another example, only one of a plug assembly or a receptacle assembly may utilize a printed circuit board therein.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An electrical connector comprising:

a first housing defining a cavity therein;

a first contact module holder coupled to the first housing and having an upper portion and a lower portion;

a second contact module holder coupled to the first housing and having an upper portion and a lower portion;

a first printed circuit board disposed in the cavity of the first housing and configured to couple to the first contact module holder by sliding between the upper portion of the first contact module holder and the lower portion of the first contact module holder, the first printed circuit board having a first contact pad positioned on a surface of the first printed circuit board;

a second housing defining a cavity therein;

a second printed circuit board disposed in the cavity of the second housing and configured to slide between the upper portion of the second contact module holder and the lower portion of the second contact module holder when the first housing and the second housing are mated together, the second printed circuit board having a second contact pad positioned on a surface of the second printed circuit board; and a contact module coupled to the first contact module holder and the second contact module holder, the contact module including a contact having a first end that directly connects to the first contact pad of the first printed circuit board and having a second end that directly connects to the second contact pad of the second printed circuit board when the first housing and the second housing are mated together.

2. The electrical connector of claim 1 wherein both the first end and the second end of the contact have a curved portion, the curved portion of the first end of the contact configured to engage with the first contact pad of the first printed circuit board and the curved portion of the second end of the contact configured to engage with the second contact pad of the second printed circuit board when the first housing and the second housing are mated together.

3. The electrical connector of claim 1 wherein the first contact module holder includes a first contact pocket and the second contact module holder includes a second contact pocket, the first end of the contact of the contact module at least partially received by the first contact pocket and the second end of the contact of the contact module at least partially received by the second contact pocket.

4. The electrical connector of claim 1 wherein the contact module holder is formed as a single component.

5. The electrical connector of claim 1 wherein the contact module includes a plurality of contacts for holding the plurality of contacts in a predetermined orientation with the first housing.

6. The electrical connector of claim 5 wherein the contact module includes a plurality of wafers forming a block.

7. A connector for providing an electrical connection between a first conductor and a second conductor, the connector comprising:

a first housing coupled to the first conductor;

a first circuit board coupled to the first housing and having a first contact pad on the first circuit board, a second contact pad on the first circuit board adjacent to the first contact pad of the first circuit board, a third contact pad on the first circuit board electrically connected with the first contact pad of the first circuit board, and a fourth contact pad on the first circuit board adjacent to the third contact pad of the first circuit board and electrically connected with the second contact pad of the first circuit board;

a second housing coupled to the second conductor and configured to mate with the first housing;

a second circuit board coupled to the second housing and having a first contact pad on the second circuit board, a second contact pad on the second circuit board adjacent to the first contact pad of the second circuit board, a third contact pad on the second circuit board electrically connected with the first contact pad of the second circuit board, and a fourth contact pad on the second circuit board adjacent to the third contact pad of the second circuit board and electrically connected with the second contact pad of the second circuit board;

a first contact module holder having an upper portion and a lower portion, the first contact module holder configured to receive the first circuit board between the upper portion and the lower portion of the first contact module holder;

a second contact module holder having an upper portion and a lower portion, the second contact module holder configured to receive the second circuit board between the upper portion and the lower portion of the second contact module holder when the first housing and the second housing are mated together; and a contact module coupled to the first contact module holder and the second contact module holder, the contact module including a first contact having a first end that directly connects to the first contact pad of the first circuit board and a second end that directly connects to the first contact pad of the second circuit board when the first housing and the second housing are mated together and a second contact having a first end that directly connects to the second contact pad of the first circuit board and a second end that directly connects to the second contact pad of the second circuit board when the first housing and the second housing are mated together.

8. The connector of claim 7 wherein:

the third contact pad of the first circuit board or the fourth contact pad of the first circuit board is configured to electrically connect with the first conductor and the third contact pad of the second circuit board or the fourth contact pad of the second circuit board is configured to electrically connect with the second conductor.

9. The connector of claim 7 further comprising a rib positioned between the first contact and the second contact for isolating the first contact from the second contact.

10. The connector of claim 7 wherein:

the first contact pad of the first circuit board is disposed on a first surface of the first circuit board and the second contact pad of the first circuit board is disposed on the first surface of the first circuit board in a staggered configuration with the first contact pad of the first circuit board and the first contact pad of the second circuit board is disposed on a first surface of the second circuit board and the second contact pad of the second circuit board is disposed on the first surface of the second circuit board in a staggered configuration with the first contact pad of the second circuit board.

11. The connector of claim 10 wherein the first end and the second end of the first contact have a curved segment and the first end and the second end of the second contact have a curved segment, the curved segment of the first end of the first contact and the curved segment of the first end of the second contact staggered in position with respect to each other, and the curved segment of the second end of the first contact and the curved segment of the second end of the second contact staggered in position with respect to each other.

12. The connector of claim 7 wherein:

the first contact pad of the first circuit board is disposed on a first surface of the first circuit board and the second contact pad of the first circuit board is disposed on a second surface of the first circuit board opposing the first surface of the first circuit board and the first contact pad of the second circuit board is disposed on a first surface of the second circuit board and the second contact pad of the second circuit board is disposed on a second surface of the second circuit board opposing the first surface of the second circuit board.

13. The connector of claim 7 wherein the first housing and the second housing are configured to mate in only one orientation.

14. The connector of claim 13 further comprising a keying slot in the first housing or the second housing for ensuring the first housing and the second housing can mate in only one orientation.

15. A connector for providing an electrical connection between at least one first cable and at least one second cable, the connector comprising:

a first assembly including a first outer housing defining a first opening, the first opening configured to receive the at least one first cable, a first body positioned at least partially in the first outer housing, a first contact module holder connected to the first body and having an upper portion and a lower portion, the first contact module holder defining a first contact pocket, a second contact module holder connected to the first body and having an upper portion and a lower portion, the second contact module holder defining a second contact pocket, a first printed circuit board connected to the first body and configured to electrically connect to the at least one first cable, the first printed circuit board configured to slide between the upper portion and the lower portion of the first contact module holder, and a contact module configured to couple to the first contact module holder and the second contact module holder, the contact module having a conductive contact with a first end disposed in the first contact pocket and a second end disposed in the second contact pocket, the first end of the conductive contact directly connected to the first printed circuit board; and a second assembly configured to mate with the first assembly, the second assembly including a second outer housing defining a second opening, the second opening configured to receive the at least one second cable, a second body positioned at least partially in the second outer housing, a second printed circuit board connected to the second body and configured to electrically connect to the at least one second cable, the second printed circuit board configured to slide between the upper portion and the lower portion of the second contact module holder when the first assembly and the second assembly are mated together, and a conductive pad disposed on a first surface of the second printed circuit board and configured to directly connect with the second end of the conductive contact of the contact module when the first assembly and the second assembly are mated together.

16. The connector of claim 15 wherein the contact module has a second conductive contact with a first end and a second end, the first end of the second conductive contact electrically connected to the first printed circuit board and further comprising a second conductive pad disposed on the first surface of the second printed circuit board and adjacent to the conductive pad, the second conductive pad configured to engage with the second end of the second conductive contact of the contact module when the first assembly and the second assembly are mated together.

17. The connector of claim 15 wherein the contact module has a second conductive contact with a first end and a second end, the first end of the second conductive contact electrically connected to the first printed circuit board and further comprising a second conductive pad disposed on a second surface of the second printed circuit board, the second conductive pad configured to engage with the second end of the second conductive contact of the contact module when the first assembly and the second assembly are mated together.

18. The connector of claim 15 wherein the second end of the conductive contact has a curved portion for slidably engaging with the conductive pad, a length of the curved portion protruding from the contact pocket receiving the conductive contact.

19. The connector of claim 18 wherein the first contact module holder has a first planar wall and a second planar wall parallel with the first planar wall for forming the first contact pocket therebetween for isolating the first end of the conductive contact.

20. The connector of claim 19 wherein the second contact module holder has a first planar wall and a second planar wall parallel with the first planar wall of the second contact module holder for forming the second contact pocket therebetween for isolating the second end of the conductive contact.

* * * * *